US009182695B2

(12) United States Patent
Ishii

(10) Patent No.: US 9,182,695 B2
(45) Date of Patent: Nov. 10, 2015

(54) EXTERNAL ADDITIVE FOR TONER, TONER COVERED WITH EXTERNAL ADDITIVE, DEVELOPMENT AGENT, TONER CONTAINER, AND IMAGE FORMING APPARATUS

(71) Applicant: Masayuki Ishii, Shizuoka (JP)

(72) Inventor: Masayuki Ishii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/059,603

(22) Filed: Oct. 22, 2013

(65) Prior Publication Data

US 2014/0134527 A1 May 15, 2014

(30) Foreign Application Priority Data

Nov. 14, 2012 (JP) ..... 2012-250433

(51) Int. Cl.
*G03G 9/097* (2006.01)
*G03G 9/087* (2006.01)

(52) U.S. Cl.
CPC ..... *G03G 9/08755* (2013.01); *G03G 9/09733* (2013.01)

(58) Field of Classification Search
CPC ..... G03G 9/09733; G03G 9/08755
USPC ..... 430/108.6, 108.7, 109.4; 399/222
See application file for complete search history.

(56) References Cited

U.S. PATENT DOCUMENTS

| | | | | |
|---|---|---|---|---|
| 5,506,671 | A * | 4/1996 | Buts et al. | 399/39 |
| 5,800,959 | A * | 9/1998 | Ikami | 430/123.51 |
| 6,120,959 | A * | 9/2000 | Sugizaki et al. | 430/108.9 |
| 2006/0063081 | A1 | 3/2006 | Nagatomo et al. | |
| 2006/0204883 | A1 | 9/2006 | Nakayama et al. | |
| 2006/0240351 | A1 | 10/2006 | Sugiura et al. | |
| 2007/0031748 | A1 | 2/2007 | Kotsugai et al. | |
| 2007/0059628 | A1 | 3/2007 | Tanaka et al. | |
| 2007/0275315 | A1 | 11/2007 | Nagatomo et al. | |
| 2008/0014527 | A1 | 1/2008 | Kotsugai et al. | |
| 2008/0226998 | A1 | 9/2008 | Ishii et al. | |
| 2008/0268366 | A1 | 10/2008 | Nakayama et al. | |
| 2009/0074467 | A1 | 3/2009 | Seshita et al. | |
| 2009/0311618 | A1* | 12/2009 | Lee et al. | 430/108.23 |
| 2011/0136051 | A1 | 6/2011 | Ishii et al. | |

FOREIGN PATENT DOCUMENTS

| | | |
|---|---|---|
| JP | 2001-066820 | 3/2001 |
| JP | 2007-156099 | 6/2007 |
| JP | 2007-248911 | 9/2007 |

OTHER PUBLICATIONS

Diamond, "The Handbook of Imaging Materials," Marcel Dekker, NY, NY 1991.*

* cited by examiner

*Primary Examiner* — Peter Vajda
(74) *Attorney, Agent, or Firm* — Oblon, McClelland, Maier & Neustadt, L.L.P.

(57) ABSTRACT

An external additive for toner that contains a resin particle and two or more kinds of particulates having different compositions present on the resin particle.

18 Claims, 1 Drawing Sheet

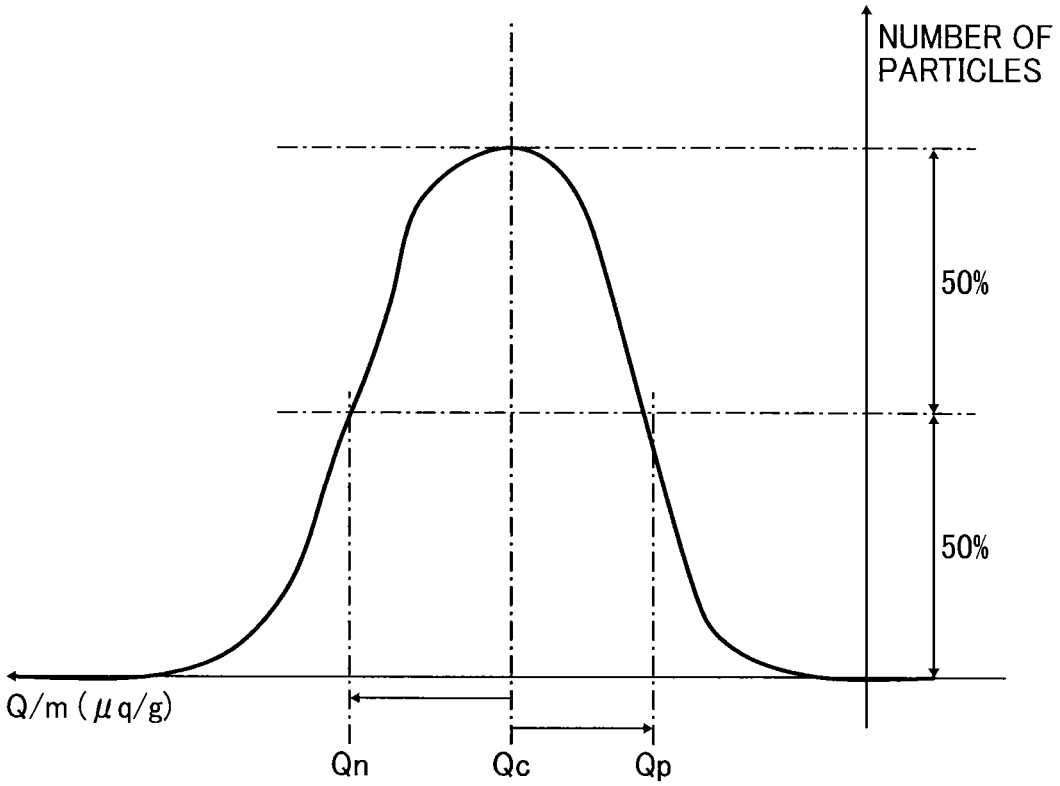
NUMBER OF PARTICLES
50%
50%
Q/m (μq/g)
Qn
Qc
Qp

EXTERNAL ADDITIVE FOR TONER, TONER COVERED WITH EXTERNAL ADDITIVE, DEVELOPMENT AGENT, TONER CONTAINER, AND IMAGE FORMING APPARATUS

CROSS-REFERENCE TO RELATED APPLICATIONS

This patent application is based on and claims priority pursuant to 35 U.S.C. §119 to Japanese Patent Application No. 2012-250433, filed on Nov. 14, 2012, in the Japan Patent Office, the entire disclosure of which is hereby incorporated by reference herein.

BACKGROUND

1. Technical Field

The present invention relates to an external additive for toner, toner covered with the external additive, a development agent using the toner, a toner container, and an image forming apparatus.

2. Background Art

Typically, toner for developing latent electrostatic images contains external additives of particulates having an average primary particle diameter of from several nm to several tens nm. For example, hydrophobized silica particulates are used to impart chargeability, fluidity, and hydrophobicity to toner. To sustain chargeability and suppress the variation of charge size in a high temperature and humidity environment, hydrophobized titanium oxide, etc. is used in general. Recently, particles having a large particle diameter such as large silica have begun to be in use as external additives.

By adding such hydrophopbized silica or metal oxides to toner as external additives, the toner can demonstrate fluidity, chargeability, environment stability, etc., which just mother toner particles cannot secure.

Also, as technologies to cover toner particles with external additives, for example, JP-2001-066820-A discloses a particular mono-dispersed spherical silica having a true specific gravity of from 1.3 to 1.9 and a volume average particle diameter of from 80 nm to 300 nm as an external additive to toner. According to JIS 2001-066820-A mentioned above, this particular silica secures fluidity, chargeability, developability, transferability, and fixability of toner at the same time for a long period of time.

In addition, JP-2007-248911-A discloses toner that contains coloring agent particles, external additives, and organic particles having fine pores on its surface which has, for example, a cross-linking density of from 3% by weight to 15% by weight, a total volume of the fine pores of from 0.01 cc/g to 0.50 cc/g, a specific surface area of from 5 $m^2/g$ to 50 $m^2/g$, and an average pore diameter of the fine pores of from 0.01 μm to 2.0 μm. According to JP-2007-248911-A mentioned above, toner is provided which can prolong the working life of an image forming apparatus and a development agent in addition to suppressing the degradation of images and also, a development agent, an image forming method, and a process cartridge that use the toner are provided.

In addition, JP4668778-B (JP-2007-156099-A) discloses using at least three kinds of hydrophobic fine powder having different average primary particle diameters as an external additive of toner. According to JP4668778-B (JP-2007-156099-A) mentioned above, toner is provided which sustains good transferability and cleanability for an extended period of time, prevents occurrence of filming on an image bearing member (photoreceptor), suppresses variation of unevenness of images, and in addition, exhibits excellent stability free or little from sinkage of external additives in toner caused by stirring a development agent during usage and with no or little variation of fluidity and chargeability for an extended period of time. Also, there are provided a development agent, a toner container, a process cartridge, and an image forming method that use the toner.

Although methods or technologies including covering the surface of toner particles with surface-treated particulates are successful to some degree, these need further improvement.

For example, problems such as sinkage of external additives present on the surface of mother toner particles, attachment status, prevention of degradation of properties, and detachment. should be solved.

Therefore, early provision of toner having excellent cleanability, image quality, and durability by covering the surface of the toner efficiently with a small amount of additives is in demand. Also, a development agent and an image forming method that use the toner are also in demand.

Conventionally, surface-reforming methods including attaching particulates to the surface of mother toner particles have been employed to impart demanded properties. However, this kind of reforming by external additives has disadvantages such that attached particles are easily detached from mother toner particles or sunk therein due to external stresses. As a result, the surface properties of the toner particles changes, which leads to change of the properties of toner, thereby degrading the high temperature stability and the fixability and changing the charging size, the fluidity, and the agglomeration degree of the toner. As a consequence, the image quality tends to deteriorate, for example, transfer of images becomes poor and back ground fouling occurs.

SUMMARY

The present invention provides improved external additive for toner containing a resin particle: and two or more kinds of particulates having different compositions present on the resin particle.

BRIEF DESCRIPTION OF THE DRAWINGS

FIGURE is a chart illustrating an example of the charging size distribution curve for use in evaluating the charging stability of Examples.

DETAILED DESCRIPTION

In view of the foregoing, the present invention was made to provide an external additive for toner. When the external additive (external additive particle) for toner is attached to the surface of a mother toner particle, the durability of the toner is improved to external stress without detachment or transfer of the external additive from the mother toner particle or sinkage thereof in the mother toner particle. Also the toner has excellent high temperature stability while suppressing property changes of, for example, charging size, fluidity, and agglomeration level so that the degradation of the image quality is reduced.

Hereinafter, toner is also referred to as "toner for electrostatic development".

As a result of an investigation, the present inventor found that the issues described above was solved by using resin particles covered with at least two different kinds of particulates having different compositions as an external additive for use in toner containing a binder resin and the external additive. Thus, the present invention was made.

The issues described above are solved by an external additive for toner in which two or more kinds of particulates having different compositions are present on resin particles.

Since the external additive for toner of the present disclosure is formed of a resin particle covered with at least two kinds of particulates having different compositions, when the external additive is attached to a mother toner particle containing a binder resin, the toner is durable to external stress without detachment or transfer of the external additive from the mother toner particle or sinkage thereof in the mother toner particle and has excellent high temperature stability while suppressing property changes of, for example, charging size, fluidity, and agglomeration level so that the degradation of the image quality is reduced.

The external additive for toner of the present disclosure is covered with two or more kinds of particulates having different compositions.

The volume average particle diameter Dv of the particulates is preferably 100 nm or less and more preferably from 6 nm to 80 nm. The detail thereof is described later. The external additive for toner is suitably used to cover mother toner particles containing a binder resin (optionally containing a coloring agent, etc.).

That is, if the external additive for toner of the present disclosure is present on a mother toner particle containing a binder resin, the change of the property such as for example, charging size, fluidity, and agglomeration level of the toner is reduced due to the resin particle covered with two or more kinds of particulates having different compositions, thereby sustaining the chargeability and suppressing the variation of the charging size under various temperature and humid environments.

In addition, the external additive never or little moves or detaches from the surface of the mother toner particle or sinks therein. "the external additive for toner of the present disclosure is present on a mother toner particle" means "a state in which a mother toner particle is covered with the external additive for toner of the present disclosure".

In addition, toner is provided which has good durability by improvement of the covering property of mother toner particle due to the effect of the external additive (resin particle).

In addition, a development agent using the toner, a toner container, and an image forming apparatus are also provided.

As described above, the external additive for use in toner (toner for developing electrostatic image) contains a resin particle covered with two or more kinds of particulates having different compositions.

Hereinafter, "two or more kinds of particulates having different compositions" is also referred to as "two or more kinds of particulates".

The two or more kinds of particulates are preferably metal compound particulates having different compositions and particularly preferably a combination of particulates containing silica and particulates containing a non-silica containing metal compound particulates. In addition, it is preferable to use particulates having a hydrophobized surface as at least one of the two or more kinds of particulates.

Hereinafter, "the surface treated with hydrophobization" is also referred to as "surface-treated".

For example, it is preferable that one of the two kinds of particulates is a surface treated silica particle and the other is a metal compound particle selected from a metal oxide, metal soap, or a metal salt excluding silicon.

Although the mechanism is not clear in detail, it was found that the charging size is maintained and sustained well when mother toner particles are covered with such a combination of particulates.

In addition, by using resin particles covered with two or more kinds of particulates, it was also found that a good fluidity is obtained in comparison with silica particles having the same diameter as the resin particles. This is considered as an effect obtained as a result of demonstration of reducing friction due to minor roughness made on the surface of the resin by covering the surface with two or more kinds of particulates in comparison with particles having uniform surfaces.

In addition, by selecting a surface-treated silica particle as one of the two or more kinds of particulates, chargerbility is improved, fluidity is controlled, for example, excessive fluidity is suppressed, and agglomeration degree is lowered, thereby keeping suitable values. Also, slipping property of the particle at structure members that contacts the particle is secured. As a consequence, transferablity is improved, removal of residual toner on an image bearing member ameliorates, and damage to an image bearing member is suppressed.

Furthermore, by using a metal compound particle (for example, surface-hydrophobized titanium oxide) as another particulate of the two or more kinds of particulates, chargeability is maintained, the variation of charging size is reduced, and quick rise charging is made possible. As a result, it is expected that the performance of toner is improved as toner for electrophotography and the life length of the machine is prolonged.

The resin particle covered with two or more kinds of particulates in the present disclosure can be formed by externally adding the particulates to the surface of mother toner particle by a conventional powder mixer (for example, HENSCHEL MIXER). The resin particle is easily irregularized by such external addition by a mixer. Therefore, it is expected that the contact surface of the resin particle with the surface of mother toner particle increases in comparison with spherical forms. As a result, the resin particle is prevented from moving or detaching from the surface of the mother toner particle or sinking therein. In addition, according to minor roughness made on the surface of the resin particle, fluidity is imparted more than particles having uniform surfaces. For this reason, it is expected to reduce friction.

That is, since mother toner particles are covered with the two or more kinds of particulates (for example, a combination of silica containing particulates and non-silica containing particulates), various properties (for example, physical properties of toner, high temperature stability, fixability, charging size, fluidity, agglomeration degree) at issue in the present disclosure are sufficiently maintained and the features required as toner for electrostatic development are demonstrated for an extended period of time.

Next, embodiments of the present disclosure are described with reference to accompanying drawings.

The external additive for toner of the present disclosure is covered with two or more kinds of particulates having different compositions and as described above, the two or more kinds of particulates are preferably a combination of silica-containing particulates and non-silica-containing particulates. In particular, it is preferable to use a resin particle covered with a surface-hydrophobized silica particle and a metal compound particle selected from a metal oxide, metal soap, or a metal salt excluding silicon.

Resin Particle

The resin particle forming the external additive for toner of the present disclosure can be manufactured by a pulverization method, a polymerization method, or a supercritical method. Such resin particles achieve the features to solve the issues of the present disclosure.

Specific examples of the super critical method includes, but are not limited to, Rapid Expansion of Supercritical Fluid Solutions (RESS method), Gas Anti-Solvent (GAS method), and new Freeze Granulation by Supercritical Fluid (FG-SCF) that can form agglomeration elements of porous particulates.

There is no specific limit to the resin that constitutes the resin particle. Specific examples thereof include, but are not limited to, non-cross-linked acrylic resins (hereinafter referred to as acrylic resins), cross-linked acrylic resins, non-cross-linked polyethylene resins, and cross-linked polystyrene resins.

The resin particle preferably has a primary particle diameter of from 25 nm to 200 nm. When the particle diameter is too small, the difference of the particle diameters between the resin particle and the particulates used to cover the resin particle decreases, which makes it difficult to stably cover the resin particles uniformly by the two or more kinds of particulates. By contrast, when the particle diameter is too large, the surface of the resin particle is easily covered but the particle diameter increases excessively as an external additive. As a result, the surface of an image bearing member may be damaged or a cleaning blade may chip.

As described above, as the two or more kinds of particulates to cover a resin particle forming an external additive, it is preferable to select particulates having different metal compounds and particularly preferably a combination of particulates containing silica and particulates containing a metal compound other than silica. In addition, it is preferable to use at least one kind of surface treated particulate as the two or more kinds of particulates to cover the resin particle. Specific examples are surface treated silica particles and metal compound particles selected from a metal oxide, metal soap, or a metal salt excluding silicon. Furthermore, surface-treated metal compound particles are also preferably used. In addition, it is preferable that the silica particles and the metal compound particle are hydrophobic.

A specific example of the surface-treated silica particulate is hydrophobic silica formed by treating the hydrophilic surface of the silica with a hydrophobic group (for example, alkyl group or alkyl silane).

Specific examples of the surface treating agent for hydrophobization include, but are not limited to, hexamethyl disilazane, polymethyl siloxane, and methyl chlorosilane.

The content (mass ratio) of the surface-hydrophobized silica particle is preferably from 30% to 95% to the total amount of the resin particle. By setting the content of the surface-hydrophobized silica particle in the range of from 30% to 95%, the surface of toner is suitably covered and the toner is durable to external stress by using a small addition amount of the silica particle. Therefore, the fluidity, the agglomeration degree, and the stability over time as toner particle are suitably maintained.

Preferred specific examples of metal compound particles include, but are not limited to, metal oxides containing titan, aluminum, or cerium, metal soap containing zinc, calcium, or magnesium, metal carbonates or phosphorate selected from calcium or magnesium. For example, metal soap such as zinc stearate and metal oxides such as titanium oxide are particularly preferable.

Surface-treated metal compound particles are furthermore preferable. A specific example thereof is hydrophobic titan having a surface treated with a hydrophobic group (for example, alkyl group, alkyl silane, reactive silicone oil).

The content (mass ratio) of the metal compound particle is preferably from 5% to 70% to the total amount of the resin particle. By setting the content (mass ratio) of the metal compound particle in the range of from 5% to 70%, the surface of toner is suitably covered and the toner is durable to external stress by a small addition amount of the metal compound particle. Therefore, the fluidity, the agglomeration degree, and the stability over time as toner particle are suitably maintained.

The two or more kinds of particulates present on the resin particle preferably has a volume average particle diameter Dv less than 100 nm and more preferably from 6 nm to 80 nm. Specific examples thereof include, but are not limited to surface treated silica particles and metal compound particles excluding silicon.

When the volume average particle diameter Dv is too large, the appearance of the surface of a coated resin particle becomes rougher depending on the form of particulates derived from its size.

Furthermore, when the volume average particle diameter Dv of the particulate is too small, the particulates tend to agglomerate easily so that strongly-agglomerated particulates are attached to a resin particle, which is not preferable. When the volume average particle diameter Dv of the particulate is too small, the appearance of surface of a coated resin particle becomes rougher, thereby causing physical sliding friction, which prevents stable fluidity.

As described above, the additive is mixed by a typical powder mixer and a mixer having a jacket, etc. is preferable to adjust the internal temperature. To change the history of the burden applied to the external additive, adding the external additive in the midstream or little by little during mixing is suitable. It is also possible to change the number of rotations, rolling speed, time, temperature, etc. of the mixer.

Heavy load followed by relatively light load or vice versa is applicable. Specific examples of the mixers include, but are not limited to, V-type mixers, Rocking mixers, Lodige mixers, Nautor mixers, and Henschel mixers.

Other External Additive

The external additive for toner of the present disclosure contains two or more kinds of particulates (for example, surface-treated silica particles and metal compound particles selected from non-silica metal oxide particles, metal soap particles, and metal salt particles) and optionally contains other external additives unless otherwise they are not beyond the scope of the present disclosure.

Specific examples thereof include, but are not limited to, particulates of cerium oxide, calcium carbonate, barium titanate, melamine, hydroxyapertite, and porous organic particles.

As described above, the toner of the present disclosure contains a mother toner particle containing a binder resin, wherein the external additive of the present disclosure is present on the mother toner particle.

Binder Resin

There is no specific limit to the binder resin contained in the mother toner particles forming the toner of the present disclosure and any known binder resin can be selected based on a particular purpose. Specific examples of the binder resins include, but are not limited to, styrene polymers and substituted styrene polymers such as polystyrene, poly-p-styrene, and polyvinyltoluene; styrene copolymers such as styrene-p-chlorostyrene copolymers, styrene-propylene copolymers, styrene-vinyltoluene copolymers, styrene-methyl acrylate copolymers, styrene-ethyl acrylate copolymers, styrene-methacrylate copolymers, styrene-methyl methacrylate copolymers, styrene-ethyl methacrylate copolymers, styrene-butyl methacrylate copolymers, styrene-α-methyl chloromethacrylate copolymers, styrene-acrylonitrile copolymers, styrene-vinyl methyl ether copolymers, styrene-vinyl methyl ketone copolymers, styrene-butadiene copolymers, styrene-isopropylene copolymers, and styrene-maleic acid ester copolymers; and other resins such as polymethyl methacrylate, polybutyl methacrylate, polyvinyl chloride, polyvinyl acetate, polyethylene, polyesters, epoxy resins, polyurethane resins, polyvinyl butyral resins, polyacrylic resins, rosin, modified rosins, terpene resins, phenol resins, aliphatic or aromatic hydrocarbon resins, and aromatic petroleum resins. These resins can be used alone or in combination.

In particular, polyesters are preferable among the resin materials mentioned above and urea modified polyesters are more preferable. Combinations of urea-modified polyesters and non-modified polyesters or urea-modified polyesters, non-modified polyesters, and crystalline polyesters are also preferable.

The mother toner particle can be manufactured by, for example, a pulverization method or an emulsification polymerization method, a polymer suspension, and a polymer suspension method that include emulsifying, suspending, and agglomerating an oil phase in an aqueous medium to form particles. That is, as the mother toner particle, materials can be used which are obtained by putting a mixture containing a toner component in a melt-kneading machine to prepare a melt-kneaded matter followed by pulverization and classification or emulsifying or dispersing a toner liquid material (oil phase) in which a toner material containing a toner composition is dispersed or dissolved in an organic solvent in an aqueous medium (aqueous phase) followed by removal of the solvent.

In the present disclosure, the toner material is also referred to as toner composition.

In the case in which the solvent is removed to prepare mother toner particles after emulsifying or dispersing the toner liquid material (oil phase) in the aqueous medium (aqueous phase), for example, it is possible to conduct solvent removal after emulsifying or dispersing the toner liquid material (oil phase) in which a toner material containing at least a binder resin and/or a binder resin precursor is dissolved or dispersed in an aqueous medium (aqueous phase).

The binder resin and/or the binder resin precursor may contain a resin material containing at least one of a non-modified polyester having only ester bonding units, a modified polyester having ester bonding units and other bonding units, and a crystalline polyester. Any resin precursor that can produce the modified polyester is usable.

Non-Modified Polyester

It is possible to use a polyester that is not modified (so-called non-modified polyester) which contains no bonding units other than ester bonding units (i.e., containing only ester bonding units) as the binder resin. A binder resin (toner binder) component can be prepared by a combination of such a non-modified polyester, a binder resin precursor having ester bonding units, a modified polyester having ester bonding units and other bonding units or a resin precursor that can produce a modified polyester, and a crystalline polyester.

For example, a non-modified polyester and a modified polyester (for example, a urea-modified polyester) can be contained as a toner binder component.

This combinational use of the modified polyester and the non-modified polyester is more preferable to a single use of the modified polyester in terms of improvement of the low temperature fixability and the gloss property when the toner is used in a full-color image forming apparatus.

It is preferable that the non-modified polyester resin and the modified polyester resin are at least partially compatible in each other in terms of low temperature fixing property and hot offset resistance. For this reason, it is preferable that the polyester component forming the modified polyester and the component forming the non-modified polyester are similar to each other.

The peak molecular weight of the non-modified polyester is from 1,000 to 30,000, preferably from 1,500 to 10,000 and more preferably from 2,000 to 8,000. The peak molecular weight of the polyester (ii) is from 1,000 to 30,000 and preferably from 1,500 to 10,000 and more preferably from 2,000 to 8,000. When the peak molecular weight is too small, the high temperature stability of the toner tends to deteriorate. When the peak molecular weight is too large, the low temperature fixability easily deteriorates. The weight average molecular weight of the non-modified polyester is preferably from 2,000 to 90,000 and the glass transition temperature (Tg) is preferably from 40° C. to 80° C.

The hydroxyl value of the non-modified polyester is preferably 5 or higher, more preferably from 10 to 120 and furthermore preferably from 20 to 80. A hydroxyl value that is too small is disadvantageous in terms of having a good combination of the high temperature preservability and the low temperature fixing property.

The acid value of the non-modified polyester is from 1 to 30 and preferably from 5 to 20. The non-modified polyester having an acid value tends to cause produced toner to have a negative chargeability.

In addition, when toner has an acid value and a hydroxyl value outside the range specified above, the image quality of produced images tends to be inferior in a high temperature and high humidity environment or in a low temperature and low humidity environment.

Modified Polyester Resin

The modified polyester contains at least ester bonding units and bonding units other than the ester bonding units in its molecular structure. Such a modified polyester can be prepared by reaction of a compound having an active hydrogen group and a resin precursor that has a polyester having a functional group reactive with the active hydrogen group of the compound and can produce a so-called modified polyester.

A specific example of the polyester having a functional group reactive with the active hydrogen group is a polyester prepolymer having an isocyante group or an epoxy group. Such a polyester having a functional group reactive with the active hydrogen group can be easily synthesized by reaction between a known isocyanating agent or epoxylating agent (a compound having an isocyante group or an epoxy group) and a polyester serving as a base.

A binder resin that contains a modified polyester (modified polyester having an ester bonding and a urea bonding) synthesized by elongation reaction between a polyester (polyester prepolymer) having an isocyante group and a compound having an active hydrogen group (e.g., amine) has a larger difference between the lowest fixing temperature and the hot offset occurring temperature, which leads to improvement of the releasing width. In comparison with a known polyester based toner, the toner having a mother toner particle for use in the present disclosure tends to have a relatively good high temperature stability when a urea-modified polyester is contained as a modified polyester in the toner even if the glass transition temperature is low.

The isocyanating agent can be selected among known products. Specific examples thereof include, but are not limited to, aliphatic polyisocyanates, alicyclic polyisocyanates, aromatic diisosycantes, aromatic aliphatic diisocyanates, isocyanurates, blocked polyisocyanates in which the polyisocyanate mentioned above is blocked with a phenolic derivative, oxime or caprolactam, and combinations thereof. A specific example of the epoxificating agent is epichlorohydrin.

Crystalline Polyester

As described above, the binder resin having an ester bonding in the mother toner particle forming the toner of the present disclosure optionally contains a crystalline polyester.

The crystalline polyester is prepared by reaction between an alcohol component and an acid component and at least has a melting point.

There is no specific limit to the crystalline polyester. Crystalline polyesters synthesized by reaction between an alcohol component and a dicarboxylic acid. Preferred specific examples of the alcohol component includes, but are not limited to, alcohol components of saturated aliphatic diol compounds having 2 to 12 carbon atoms, in particular, 1,4-butan diol, 1,6-hexane diol, 1,8-8 octane diol, 1,10-decane diol, 1,12-dodecane diol, and derivatives thereof. Preferred specific examples of the dicarboxylic component include, but are not limited to, dicarboxylic acid components of dicarboxylic acids having carbon-carbon double bonding with 2 to 12 carbon atoms or saturated dicarboxylic acids having 2 to 12 carbon atoms, in particular, fumaric acid, 1,4-butane dacid, 1,6-hexane diacid, 1.8-octane diacid, 1,10-decane diacid, 1,12-dodecane diacid, and derivatives thereof.

By using a crystalline polyester, for example, contamination of carriers and a charging member by wax present on the surface of toner having a mother toner particle is suppressed while maintaining the releasing performance during fixing without deterioration and good results are obtained.

The content of the crystalline polyester is preferably from 1 part by weight to 100 parts by weight to 100 parts by weight of the mother toner particle. When the content is too small, the low temperature fixability easily deteriorates. When the content is too large, the image quality tends to deteriorate due to contamination of an image bearing member or other members, the fluidity of a development agent containing the toner is easily worsened, or the image density tends to become thin since the content of the crystalline polyester is present excessively on the uppermost surface of the toner. In addition, the surface form of the toner easily deteriorates and the carrier is contaminated so that the chargeability of the toner is not maintained sufficiently for a long period of time and furthermore, the environment stability is inhibited in some cases.

As described above, the binder resin (toner binder) for the mother toner particle forming the toner of the present disclosure can be arbitrarily selected from, for example, a blended resin of the non-modified polyester and the modified polyester (polyester having ester bonding units and bonding units other than the ester bonding unit), a blended resin of the non-modified polyester and the crystalline polyester, and a blended resin of the non-modified polyester, the non-modified polyester, and the crystalline polyester. In such blending, it is preferable to consider striking a balance among hot offset resistance, high temperature stability, and low temperature fixability.

The glass transition temperature (Tg) of the binder resin (toner binder) in the present disclosure is preferably from 40° C. to 70° C. and more preferably from 40° C. to 65° C. When the glass transition temperature is too low, the high temperature stability of the toner tends to deteriorate. When the glass transition temperature is too high, the low temperature fixability thereof tends to become undesirable.

In comparison with known polyester based toner, the toner having a mother toner particle for use in the present disclosure tends to have a relatively good high temperature stability when a urea-modified polyester is also contained as a modified polyester in the toner even if the glass transition temperature is low.

Coloring Agent

There is no specific limit to the coloring agent used as the toner material forming the mother toner particle. Any known dye or pigment can be selected to a particular purpose. Specific examples of the coloring agents for use in the toner of the present disclosure include, but are not limited to, known dyes and pigments such as carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination.

The content of the coloring agent in the mother toner particle (colored particle) is preferably from 1% by weight to 15% by weight and more preferably from 3% by weight to 10% by weight.

Coloring agents (coloring agents) are optionally used a toner material forming the mother particle.

The coloring agent and the resin can be used in combination as a master batch. There is no specific limit to the resins for use in the master batch and any known resin can be selected to a particular purpose. Specific examples thereof include, but are not limited to, monopolymers of styrene or substituted styrene, styrene-based copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic hydrocarbon resins, alicyclic hydrocarbon resins, aromatic petroleum resins, chlorinated paraffin, and paraffin. These can be used alone or in combination.

Releasing agents are optionally used as the toner material forming the mother toner particle.

Releasing Agent

There is no specific limit to such releasing agents and any known releasing agent can be selected to a particular purpose. A specific example thereof is wax.

Specific examples of such wax include, but are not limited to, wax having a carbonyl group, polyolefin wax, and long-chain hydrocarbons. These can be used alone or in combination. In particular, wax having a carbonyl group is preferable.

Specific examples of the wax having a carbonyl group include, but are not limited to, polyalkane acid esters, polyalkanol esters, polyalkane acid amides, polyalkyl amides, and dialkyl ketones. In particular, polyalkane acid esters are preferable.

Specific examples of the polyalkane acid esters include, but are not limited to, carnauba wax, montan wax, trimethylol propane tribehenate, pentaerythritol tetrabehenate, pentaerythritol diacetate dibehenate, glycerin tribehenate, and 1,18-octadecanediol distearate.

Specific examples of the polyalkanol esters include, but are not limited to, trimellitic acid tristearyl and distearyl maleate.

A specific example of the polyalkane acid amide is dibehenyl amide. A specific example of the polyalkyl amide is trimellitic acid tristearyl amide.

A specific example of the dialkyl ketone is distearyl ketone.

Specific examples of the polyolefine waxes include, but are not limited to, polyethylene waxes and polypropylene waxes.

Specific examples of the long-chain hydrocarbons include, but are not limited to, paraffin wax and sazol wax.

There is no specific limit to the melting point of the releasing agent. The melting point can be set to a particular purpose and is preferably from 40° C. to 160° C. When the melting point is too low, the releasing agent tends to have an adverse impact on high temperature stability. When the melting point is too high, cold offset tends to occur during fixing at low temperatures.

The releasing agent preferably has a melt viscosity of from 5 cps to 1,000 cps and more preferably from 10 cps to 100 cps at a temperature 20° C. higher than the melting point of the releasing agent. When the melt viscosity is too low, the releasing property tends to deteriorate. When the melt viscosity is too high, the hot offset resistance and the low temperature fixability of the toner are not easily improved.

There is no specific limit to the content of the coloring agent (colored particle) in the mother toner particle and the content can be determined to a particular application. The content is preferably from 1% by weight to 40% by weight and more preferably from 3% by weight to 30% by weight. When the content of the releasing agent in the in the mother toner particle is too large, the fluidity of the toner tends to deteriorate.

Charge control agents, etc. are optionally used as toner materials forming a mother toner particle.

Charge Control Agent

There is no specific limit to the charge control agent and positive or negative charge control agents can be selected to a particular application depending on the plus and minus of charges applied to an image bearing member.

For example, resins or compounds having electron donating functional groups, azo dyes, or metal complexes of organic acids can be used as the negative charge control agent.

Specific examples of such negative charge control agents include, but are not limited to, Bontron (product number: S-31, S-32, S-34, S-36, S-37, S-39, S-40, S44-, e-81, E-82, E-84, E-86, E-88, A, 1-A, 2-A, and 3-A, all manufactured by Orient Chemical Industries Co., Ltd.); KayaCharge (Product number: N-1 and N-2) and KayaSetBlack (product number: T-2 and 004, all manufactured by Nippon Kayaku Co., Ltd.), Aizen Spiron Black (T-37, T-77, T-95, TRH, TNS-2, all manufactured by Hodogaya Chemical Co., Ltd.); and FCA-1001-N, FCA-1001-NB, FCA-1001-NZ, all manufactured by Fujikura Kasei Co., Ltd.). These can be used alone or in combination.

Specific examples of the positive charge control agents include, but are not limited to, basic compounds such as modified agents such as nigrosine dyes, cationic compounds such as quaternary ammonium salt, and metal salts of higher aliphatic acids. Specific examples of such negative charge control agents include, but are not limited to, Bontron (product number: N-01, N-02, N-03, N-04, N-05, N-07, N-09, N-10, N-11, N-13, P-51, P-52, and AFP-B, all manufactured by Orient Chemical Industries Co., Ltd.); TP-302, TP-415, and TP-4040, all manufactured by Hodogaya Chemical Co., Ltd.); Copy Blue PR and Copy Charge (product number: PX-VP-435 and NX-VP-434, all manufactured by Hoechst Japan Co., Ltd.); FCA-(product number: 201, 201-B-1, 201-B-2, 201-B-3, 201-PB, 201-PZ, 301, all manufactured by Fujikura Kasei Co., Ltd.); and PZ (product number: 1001, 2001, 6001, and 7001, all manufactured by Shikoku Chemical Corporation). These can be used alone or in combination.

The content of the charge control agent is determined depending on the kinds of a binder resin and the manufacturing method of coloring agents including the dispersion method and therefore is not unambiguously defined. However, the content of the charge control agent is preferably from 0.1% by weight to 10% by weight based on the total amount of the binder resin. When the content is too large, the toner tends to have an excessively large charge size, which reduces the effect of the charge control agent, thereby increasing the electrostatic attraction force between a developing roller and the toner, which invites deterioration of the fluidity of a development agent containing the toner and a decrease of the image density of output images. When the content is too small, the charge initial rising property and the charging size of toner tend to be not sufficient, which easily has an impact on output toner images.

Method of Manufacturing Toner

As described above, the toner of the present disclosure is manufactured by covering the surface of a mother toner particle I obtained by a pulverization method or the surface of a mother toner particle II obtained by emulsifying or dispersing a toner liquid material (oil phase) in an aqueous medium (aqueous phase) with an external additive containing a non-spherical resin particles which has an outer shell layer formed of at least silica or modified silica.

The mother toner particle I or II can be suitably selected to a particular application. The mother toner particle II is preferably used to obtain a mother toner particle (colored particle) having a spherical form and a controlled particle size distribution.

When preparing mother toner particles I by a pulverization method, a mixture of toner materials forming mother toner particles (coloring agent particles) is placed in a melt-kneading machine for melt-kneading first. A single-screw or twin-screw continuous mixing and kneading machine or a batch type mixing and kneading machine by a roll mill can be used as the melting and mixing and kneading machine. Specific examples such mixing kneader include, but are not limited to, KTK type twin-screw extruders (manufactured by KOBE STEEL., LTD.), TEM type extruders (manufactured by TOSHIBA MACHINE CO., LTD), twin-screw extruders (manufactured by KCK), PCM type twin-screw extruders (manufactured by IKEGAI CORP.), and Ko-kneaders (manufactured by Buss). It is preferable that this melt-kneading is conducted under suitable conditions not to sever the molecular chain of binder resins. To be specific, when the temperature in the melt-kneading is by far higher than the softening point, the molecular chain tends to be severely severed. When the temperature is too low, the melt-kneading tends not to proceed smoothly.

Next, the melt-kneaded mixture obtained in the melt-kneading is pulverized. In the pulverization process of the melt-kneaded mixture, it is preferable to coarsely pulverize the melt-kneaded mixture before fine pulverization. To be specific, it is preferable that the kneaded mixtures are pulverized by collision with a collision board in a jet stream, collision between particles in a jet stream, or pulverization at narrow gaps between a stator and a rotor that is mechanically in rotation.

Moreover, the pulverized matter is classified to adjust the particle diameter to be in a predetermined range. In the classification, fine particles are removed by, for example, a cyclone, a decanter, or a centrifugal. Thereafter, mother toner particles are obtained by removing coarse particles and agglomerated particle using a screen having 250 meshes or more.

To obtain the mother toner particle II by emulsifying or dispersing a toner liquid material (oil phase) in an aqueous medium (aqueous phase), the mother toner particle is obtained by a method including a process of preparing the toner liquid material (oil phase) by dissolving or dispersing a toner material containing a binder resin and/or a binder resin precursor, a coloring agent, and an optional releasing agent and a process of emulsifying or dispersing the oil phase in the aqueous medium (aqueous phase) followed by removing the organic solvent.

It is preferable that the volume average particle diameter (Dv) of the mother toner particle is from 3.0 μm to less than 6.0 μm and the ratio (Dv/Dn) of the volume average particle diameter (Dv) to the number average particle diameter (Dn) of the mother toner particle is from 1.05 to 1.25.

When the volume average particle diameter (Dv) is excessively small, the toner is disadvantageous in terms of transferability and cleanability. If the volume average particle diameter is smaller than this range, the toner in a two component development agent (formed of toner and carrier) tends to adhere to the surface of the carrier when the two component development agent is stirred in a development device for a long period of time. This easily deprives the carrier of the charging power. If used in a single component development agent, filming of the toner on a development roller and cohesion of the toner on members such as a blade to regulate the thickness of the toner layer tend to occur.

By contrast, when the toner particle diameter is greater than this range, quality images with high definitions is not easily produced. In addition, when the toner in a development agent is replenished, variation of the particle diameter of the toner tends to increase. This applies to a case in which the ratio (Dv/Dn) of the volume average particle diameter (Dv) to the number average particle diameter (Dn) is greater than 1.25. In addition, a case in which the ratio (Dv/Dn) is less than 1.05 is preferable in terms of the stabilization of toner and the uniformity of charging size but unable to charge the toner sufficiently or degrades the cleanability in some cases.

The method of manufacturing toner is described about granulating mother toner particles (colored particles) by using a compound having an active hydrogen group and a resin precursor (resin precursor that can produce a modified polyester) that contains a polyester (hereinafter referred to as prepolymer A) having a functional group reactive with the active hydrogen of the compound.

Prepolymer A is obtained by reacting a polyester resin (polyester rein having an active hydrogen group) formed of a polycondensation product of a polyol 1 and a polycarboxylic acid 2 with a polyisocyanate 3. Specific examples of the active hydrogen group include, but are not limited to, hydroxyl groups (alcohol hydroxyl groups and phenolic hydroxyl groups), amino groups, carboxyl groups, and mercarpto groups. Alcohol hydroxyl group is preferable. "The polyester resin having an active hydrogen group" here is different from "the compound having an active hydrogen group".

Specific examples of the polyols 1 include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F, and bisphenol S), 4,4'-dihydroxybiphenyls such as 3,3-difluoro-4,4'-dihydroxybiphenyl; bis(hydroxyphenyl)alkanes such as bis(3-fluoro-4-hydroxyphenyl)methane, 1-phenyl-1,1'-bis(3-fluoro-4-hydroxyphenyl)ethane, 2,2-bis(3-fluoro-4-hydroxyphenyl)propane, 2,2-bis(3,5-difluoro-4-hydroxyphenyl)propane (also referred to as tetrafluorobisphenol A), and 2,2-bis(3-hydroxyphenyl)-1,1,1,3,3,3-hexafluoropropane; bis(4-hydroxyphenyl)ethers such as bis(3-fluoro-4-hydroxyphenyl)ether; adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide). Alkylene glycols having 2 to 12 carbon atoms and adducts of a bisphenol with an alkylene oxide are preferable.

A mixture of an adduct of a bisphenol with an alkylene oxide and an alkylene glycol having 2 to 12 carbon atoms is particularly preferable.

Specific examples of the polyol 1 having three or more hydroxyl groups include, but are not limited to, tri- or higher aliphatic alcohols (such as glycerin, trimethylol ethane, trimethylol propane, pentaerythritol and sorbitol); polyphenols having three or more hydroxyl groups (such as trisphenol PA, phenolic novolak and cresol novolak); and adducts of the polyphenols having three or more hydroxyl groups mentioned above with an alkylene oxide.

The polyols specified above can be used alone or in combination.

Specific examples of the polycarboxylic acids 2 include, but are not limited to, alkylene dicarboxylic acids (e.g., succinic acid, adipic acid and sebacic acid); alkenylene dicarboxylic acids (e.g., maleic acid and fumaric acid); and aromatic dicarboxylic acids (e.g., phthalic acid, isophthalic acid, terephthalic acid, naphthalene dicarboxylic acids, 3-fluoroisophtahlic acid, 2-fluoroisophthalic acid, 2-fluoroterephtahlic acid, 2,4,5,6-tetrafluoroisophtahlic acid, 2,3,5,6-tetrafluoro terephthalic acid, 5-trifluoromthyl isophthalic acid, 2,2-bis(4-carboxyphenyl)hexafluoropropane, 2,2-bis(4-carboxyphenyl)hexafluoro propane, 2,2-bis(3-carboxyphenyl) hexafluoropropane, 2,2'-bis(trifluoromethyl)-4,4'-biphenyl dicarboxylic acid, 3,3'-bis(trifluoromethyl)4,4'-biphenyl dicarboxylic acid, 2,2'-bis(trifluoromethyl)-3,3'-biphenyl dicarboxylic acid, and hexafluoro isopropylidene diphthalic anhydride). Among these compounds, alkenylene dicarboxylic acids having 4 to carbon atoms and aromatic dicarboxylic acids having 8 to 20 carbon atoms are preferable.

Furthermore, specific examples of the polycarboxylic acids having three or more hydroxyl groups include, but are not limited to, aromatic polycarboxylic acids having 9 to 20 carbon atoms (e.g., trimellitic acid and pyromellitic acid), anhydrides thereof, or lower alkyl esters (e.g., methyl esters, ethyl esters or isopropyl esters).

The polycarboxylic acids can be used alone or in combination and are not limited to the specified above.

With regard to the ratio of polyol 1 to polycarboxylic acid 2 when synthesizing a polyester resin, the equivalent ratio of [OH]/[COOH] of hydroxy group [OH] to carboxylic group [COOH] is from 2/1 to 1/1, preferably from 1.5/1 to 1/1, and more preferably from 1.3/1 to 1.02/1.

The peak molecular weight of the polyester is from 1,000 to 30,000, preferably from 1,500 to 10,000, and more preferably from 2,000 to 8,000. When the peak molecular weight is too small, the high temperature storage tends to deteriorate. When the peak molecular weight is too large, the low temperature fixability tends to deteriorate.

Specific examples of the polyisocyanates 3 include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); aromatic aliphatic diisocyanates (e.g., α,α,α',α'-tetramethyl xylylene diisocyanate); isocyanurates; and blocked polyisocyanates in which the polyisocyanates mentioned above are blocked with phenol derivatives, oximes or caprolactams. These coloring agents can be used alone or in combination.

With regard to the mixing ratio (i.e., [NCO]/[OH]) of the polyisocyanate 3 to a polyester resin having a hydroxyl group to synthesize a prepolymer A, the equivalent ratio of isocyanate group [NCO] to hydroxyl group of the polyester resin having a hydroxyl group is from 5/1 to 1/1, preferably from 4/1 to 1.2/1, and more preferably from 2.5/1 to 1.5/1. When the [NCO]/[OH] is too large, the low temperature fixability tends to deteriorate. When the [NCO]/[OH] is too small, the content of the urethane group and/or the urea group in a modified polyester resin decreases, which may lead to deterioration of hot offset resistance.

The content of the composition derived from polyisocyanate 3 in prepolymer A is from 0.5% by weight to 40% by weight, preferably from 1% by weight to 30% by weight, and more preferably from 2% by weight to 20% by weight. A content that is too low tends to degrade the hot offset resistance of toner. By contrast, when the content is too high, the low temperature fixability of toner easily deteriorates.

The number of isocyanate groups contained in one molecule of the prepolymer A is normally not less than 1, preferably from 1.5 to 3, and more preferably from 1.8 to 2.5. When the number of isocyanate groups is too small, the molecular weight of a modified polyester resin decreases, which leads to deterioration of hot offset resistance in some cases.

In the present disclosure, amine B is used as the compound (elongating agent and/or cross-linking agent) having an active hydrogen group reactive with the prepolymer A.

Specific examples of the amines B include, but are not limited to, diamine B1, polyamine B2 having three or more amino groups, amino alcohols (B3), amino mercaptans (B4), amino acids (B5), and blocked amines (B6) in which the amino group of the amines B1 to-B5 mentioned above are blocked.

Specific examples of the diamine B1 include, but are not limited to, aromatic diamines (e.g., phenylene diamine, diethyltoluene diamine, 4,4'-diaminodiphenyl methane, tetrafluoro-p-xylylene diamine, and tetrafluoro-p-phenylene diamine); alicyclic diamines (e.g., 4,4'-diamino-3,3'-dimethyldicyclohexyl methane, diaminocyclohexane, and isophorone diamine); aliphatic diamines (e.g., ethylene diamine, tetramethylene diamine, hexamethylene diamine, dodecafluoro hexylene diamine, and tetracosa fluoro dodecylene diamine).

Specific examples of the polyamine B2 having three or more amino groups include, but are not limited to, diethylene triamine and triethylene tetramine.

Specific examples of the amino alcohols B3 include, but are not limited to, ethanol amine and hydroxyethyl aniline.

Specific examples of the amino mercaptan B4 include, but are not limited to, aminoethyl mercaptan and aminopropyl mercaptan.

Specific examples of the amino acids B5 include, but are not limited to, amino propionic acid and amino caproic acid.

Specific examples of the blocked amine B6 include, but are not limited to, ketimine compounds which are prepared by reacting one of the amines B1 to B5 mentioned above with a ketone (such as acetone, methyl ethyl ketone, and methyl isobutyl ketone); and oxazoline compounds.

Furthermore, the molecular weight of the modified polyester resin can be adjusted by an optional molecular weight control agent in the cross linking reaction and/or the elongation reaction. Specific preferred examples of the molecular weight control agent include, but are not limited to, monoamines (e.g., diethyl amine, dibutyl amine, butyl amine, and lauryl amine) and blocked amines (i.e., ketimine compounds) prepared by blocking the monoamines mentioned above.

The equivalent ratio ([NCO]/[NHx]) of isocyante group [NCO] of the prepolymer A and amino group [NHx] of the amine B when conducting reaction therebetween is from 1/2 to 2/1, preferably from 1.5/1 to 1/1.5 and more preferably from 1.2/1 to 1/1.2. When the equivalent ratio ([NCO]/[NHx]) is too large or small, the molecular weight of an obtained modified polyester resin decreases, which leads to deterioration of hot offset resistance.

The organic solvent to dissolve or disperse a material (toner composition) is preferably volatile with a boiling point lower than 100□ in order to easily remove the organic solvent later. Specific examples of such organic solvents include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methylisobuthyl ketone. These can be used alone or in combination. In particular, ester based solvents such as methyl acetate and ethyl acetate, aromatic based solvent such as toluene and xylene, and halogenized hydrocarbons such as methylene chloride, 1,2-dichloroethane, chloroform and carbon tetrachloride are preferable. The toner composition can be simultaneously dissolved or dispersed but typically dissolved or dispersed in separate occasions. It is not necessary to use the same organic solvent to dissolve or disperse each of the toner composition, but using the same organic solvent is preferable considering the subsequent solvent treatment. The solution or liquid dispersion {toner liquid material (oil phase)} of a toner composition preferably has a resin concentration of from 40% by weight to 80% by weight. When the resin concentration is too high, it is not easy to dissolve or disperse the toner composition and the viscosity thereof increases, which makes handling of the solution or liquid dispersion difficult. When the resin concentration is too low, the yield of the toner becomes less. When a polyester resin is mixed with a prepolymer, these can be mixed in the same solution or liquid dispersion or manufactured on separate occasions. Considering the solubility and the viscosity of each, it is preferable to prepare a solution or liquid dispersion on separate occasions.

The coloring agent can be separately dissolved or dispersed or mixed with the solution or liquid dispersion of a polyester resin. If desired, a dispersion helping agent or a polyester resin can be added or a master batch above can also be used as described above.

When wax is dissolved or dispersed as a releasing agent in an organic solvent in which the wax is not soluble, the resultant is used as a liquid dispersion. Such a liquid dispersion is prepared by a typical method. That is, an organic solvent and a wax are mixed followed by dispersion by a dispersion device such as a bead mill. Moreover, after mixing an organic solvent and wax, the wax is heated to the melting point thereof and cooled down while stirring the mixture and thereafter, the mixture is dispersed by a dispersion device such as a bead mill. In this case, the dispersion time can be reduced in some cases. Furthermore, several kinds of waxes can be mixed for use and a dispersion improving agent or a polyester resin can be optionally added.

The aqueous medium (aqueous phase) is not limited to simple water. Mixtures of water with a solvent which can be mixed with water are also suitably usable. Specific examples of such solvents that can be mixed with water include, but are not limited to, alcohols (e.g., methanol, isopropanol, and ethylene glycol), dimethylformamide, tetrahydrofuran, cellosolves (e.g., methyl cellosolve), lower ketones (e.g., acetone and methyl ethyl ketone), etc. The content of the aqueous medium is normally from 50 parts by weight to 2,000 parts by weight and preferably from 100 parts by weight to 1,000 parts by weight based on 100 parts by weight of a toner composition. When the content of the aqueous medium is too small, the dispersion state of the toner composition is easily degraded. A content of an aqueous medium that is excessively large is not preferred in terms of cost efficiency.

When a solution of a liquid dispersion of a toner composition is dispersed in an aqueous medium, it is preferable to preliminarily disperse an inorganic dispersing agent or a resin particles in an aqueous medium. In this case, the particle size distribution becomes sharp and the dispersion is stabilized.

Specific examples of the inorganic dispersing agent include, but are not limited to, tricalcium phosphate, calcium carbonate, titanium oxide, colloidal silica, and hydroxyapatite.

There is no specific limit to selection of the resin that forms resin particles and any resin that can form an aqueous dispersion element can be used. Any thermoplastic resin or thermocuring resin can be used. Specific examples thereof include, but are not limited to, vinyl based resins, polyurethane resins, epoxy resins, polyester resins, polyamide resins, polyimide resins, silicon based resins, phenolic resins, melamine resins, urea resins, aniline resins, ionomer resins, and polycarbonate resins. These resins can be used alone or in combination. Among these resins, vinyl resins, polyurethane resins, epoxy resins, polyester resins, and mixtures thereof are preferably used because an aqueous dispersion element containing fine spherical resin particles can be easily prepared.

To emulsify and/or disperse a solution or a liquid dispersion of a toner component in an aqueous medium, a surface active agent can be used, if desired. Specific examples of the surface active agents include, but are not limited to, anionic surface active agents such as alkylbenzene sulfonic acid salts, α-olefin sulfonic acid salts, and phosphoric esters; cationic surface active agents of amine salts (e.g., alkyl amine salts, aminoalcohol fatty acid derivatives, polyamine fatty acid derivatives and imidazoline); cationic surface active agents of quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surface active agents such as fatty acid amide derivatives, polyhydric alcohol derivatives; and ampholytic surface active agents such as alanine, dodecylbis(aminoethyl)glycin, bis(octylaminoethyl-e)glycin, and N-alkyl-N,N-dimethylammonium betaine.

Dispersion is improved with an extremely small amount of a surface active agent having a fluoroalkyl group. Specific examples of the anionic surface active agents having a fluoroalkyl group include, but are not limited to, fluoroalkyl carboxylic acids having from 2 to 10 carbon atoms and their metal salts, disodium perfluorooctanesulfonylglutamate, sodium 3-{ω-fluoroalkyl(C6-C11)oxy}-1-alkyl(C3-C4) sulfonate, sodium 3-{ω-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroallyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10) sulfoneamidepropyltrimethylammonium salts, salts of perfluoroalkyl(C6-C10)-N-ethylsulfonyl glycin, monoperfluoroalkyl(C6-C16) ethylphosphates, etc. Specific examples of the cationic surface active agents include, but are not limited to, primary, secondary, or tertiary aliphatic amino acids having a fluoroalkyl group, aliphatic quaternary ammonium salts (for example, perfluoroalkyl(C6-C10)sulfoneamidepropyltrimethyl ammonium salts), benzalkonium salts, benzetonium chloride, pyridinium salts, and imidazolinium salts.

Liquid droplet dispersion can be stabilized in an aqueous medium by using a polymer protection colloid. Specific examples of such polymeric protection colloids include, but are not limited to, acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, γ-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylate, diethyleneglycol monomethacrylate, glycerinmonoacrylate, N-methylolacrylamide and N-methylol methacrylamide); vinyl alcohol and its ethers (e.g., vinyl methyl ether, vinyl ethyl ether, and vinyl propyl ether), esters of vinyl alcohol with a compound having a carboxyl group (i.e., vinyl acetate, vinyl propionate, and vinyl butyrate); acrylamide, methacrylamide, and diacetoneacrylamide and their methylol compounds, acid chlorides (e.g., acrylic acid chloride and methacrylic acid chloride); monomers having a nitrogen atom or a heterocyclic ring having a nitrogen atom (e.g., vinyl pyridine, vinyl pyrrolidone, vinyl imidazole, and ethylene imine); polyoxyethylene compounds (e.g., polyoxyethylene, polyoxypropylene, polyoxy ethylene alkyl amines, polyoxypropylene alkyl amines, polyoxy ethylenealkyl amides, polyoxypropylene alkyl amides, polyoxyethylene nonylphenyl ethers, polyoxyethylene lauryl phenyl ethers, polyoxyethylene stearylphenyl esters, and polyoxyethylene nonylphenyl esters), and cellulose compounds (e.g., methyl cellulose, hydroxyethyl cellulose, and hydroxy propyl cellulose).

When compounds such as calcium phosphate which are soluble in an acid or alkali are used as a dispersion stabilizer, it is possible to dissolve the calcium phosphate by adding an acid, for example, hydrochloric acid, followed by washing of the resultant particles with water, to remove the calcium phosphate from the colored particles. In addition, a zymolytic method can be used to remove such compounds. When a dispersing agent is used, it is possible to use colored particles on which the dispersing agent remains but it is preferable to wash and remove the dispersing agent in terms of the chargeability of toner.

There is no particular limit to the dispersion method. Low speed shearing methods, high speed shearing methods, friction methods, high pressure jet methods, ultrasonic methods, etc., can be used. The high speed shearing method is preferable to obtain a dispersion element having a particle diameter of from 2 μm to 20 μm. When a high speed shearing type dispersion machine is used, there is no particular limit to the rotation speed thereof, but the rotation speed is typically from 1,000 rpm to 30,000 rpm and preferably from 5,000 rpm to 20,000 rpm. There is no specific limit to the dispersion time but the dispersion time is typically from 0.1 minutes to 5 minutes in the batch system. The temperature during dispersion is typically from 0° C. to 150° C. (under pressure) and preferably from 20° C. to 80° C.

In order to remove the organic solvent from the thus prepared emulsion dispersion element, a method is used in which the temperature of the entire system is gradually raised at normal pressure or a reduced pressure to completely evaporate and remove the organic solvent in the droplets. Alternatively, it is possible to air-spray the emulsion dispersion element in a dry atmosphere to remove the organic solvent in the droplet and also evaporate and remove surface active agent. The dry atmosphere can be prepared by heating gases, for example, air, nitrogen, carbon dioxide gas, and combustion gases but each kind of air stream heated to temperatures to the boiling point or higher is used in general. At this point, the processing time can be shortened by using a spray drier, a belt drier, or a rotary kiln.

The amine B can be mixed in an organic solvent before dispersing a toner composition in an aqueous medium or added to an aqueous medium. The time to be taken for reaction of the prepolymer A and the amine B is determined depending on the reactivity of the prepolymer A and the amine B. The reaction time is typically from 1 minute to 40 hours and preferably from 1 hour to 24 hours. The reaction temperature is normally from 0° C. to 150° C. and preferably from 20° C. to 98° C. Any known catalyst can be optionally used.

Known methods are applied in washing and drying mother toner particles (colored particles) dispersed in an aqueous medium. That is, after separating into solid and liquid by a centrifugal or a filter press to obtain a toner cake, the obtained cake is re-dispersed in deionized water at room temperature to about 40° C. Subsequent to optional pH adjustment by an acid or an alkali, the resultant is subject to the solid and liquid separation treatment again.

This cycle is repeated several times to remove impurities, and the active surface agent. Thereafter, the resultant is dried by an air stream drier, a circulation drier, a reduced pressure drier, a vibration flow drier, etc. to obtain colored particles. To obtain a toner having a desired particle size distribution, particulate component is removed by a centrifugal or a known classifier optionally used after drying.

The mother toner particle containing a binder resin and a coloring agent formed as described above are mixed and stirred with resin particles covered with two or more kinds of particulates (selected from silica containing particulates and non-silicon containing metal compound particulates: for example, surface treated silica particles and a non-silicon containing metal compound particles) so that the surface of the mother toner particle us covered with the resin particles (external additive).

Although a conventional powder mixer can be used to add the external additive to the surface of the mother toner particle, a mixer having a jacket, etc. is preferable to adjust the internal temperature. To change the history of the burden applied to the external additive, adding the external additive in the midstream or little by little during mixing is suitable. It is also suitable to change the number of rotations, rolling speed, time, temperature, etc. of the mixer. Heavy load followed by relatively light load or vice versa is applicable.

Specific examples of the mixers include, but are not limited to, V-type mixers, Rocking mixers, Lodige mixers, Nautor mixers, and Henschel mixers.

A single component development agent or a two component development agent is formed by using the toner of the present disclosure.

The development agent of the present disclosure is a single-component development agent simply formed of the toner of the present disclosure or a two component development agent formed of carrier and the toner of the present disclosure. For a high performance printers, etc. that keep with the improvement of the processing speed, using a two component development agent is preferable in terms of the length of the working life, etc.

The mixing ratio of the toner to the carrier in a two component development agent is preferably 1 part by weight to 10 parts by weight based on 100 parts by weight of the carrier.

When a single-component development agent is used and replenished, the variation of the particle diameter of the toner is small without filming of the toner on a developing roller or fusion bonding of the toner onto members such as a blade for regulating the thickness of a toner layer. Therefore, good and stable developability and production of quality images are sustained even when the development agent is used and stirred for an extended period of time.

In a case of a two-component development agent using the toner of the present disclosure, even when the toner is replenished for an extended period of time, the change in the particle diameter of the toner in the development agent is small. In addition, good and stable developability is sustained even when the development agent is stirred in a development device for an extended period of time.

There is no specific limitation to the carrier and any known carrier can be suitably selected. Carrier having a core material and a resin layer to cover the core material is preferable.

There is no specific limit to the material for the core material and any known material can be suitably used. For example, manganese-strontium (Mn—Sr) based materials and manganese-magnesium (Mn—Mg) based materials having 50 emu/g to 90 emu/g are preferable. To secure image density, highly magnetized materials such as iron powder having 100 emu/g or more and magnetite having 75 emu/g to 120 emu/g are preferable. In addition, weakly magnetized copper-zinc (Cu—Zn) based materials having 30 emu/g to 80 emu/g are preferable in terms of reducing the impact of a toner filament formed on a development roller on an image bearing member, which is advantageous in improvement of the image quality. These can be used alone or in combination.

The core material preferably has a volume average particle diameter of from 10 μm to 200 μm and more preferably from 40 μm to 100 μm. When the weight average particle diameter is too small, fine powder component of carrier tends to increase and the magnetization per particle tends to decrease, which leads to scattering of the carrier particles. When the weight average particle diameter is too large, the specific surface area tends to decrease, resulting in scattering of toner. In a full color image in which solid portions account for a large ratio, reproducibility tends to deteriorate particularly in the solid portions.

There is no specific limit to the materials for the resin layer and any known resin can be suitably selected to a particular application. Specific examples thereof include, but are not limited to, amino-based resins, polyvinyl-based resins, polystyrene-based resins, polycarbonate-based resins, polyethylene resins, polyvinyl fluoride resins, polyvinylidene fluoride resins, polytrifluoroethylene resins, polyhexafluoropropylene resins, copolymers of vinylidenefluoride and acrylate monomer, copolymers of vinylidenefluoride and vinylfluoride, fluoroterpolymers such as terpolymers of tetrafluoroethylene, fluorovinylidene, and monomer including no fluorine atom, and silicone resins. These can be used alone or in combination.

Specific examples of the amino-based resins include, but are not limited to, urea-formaldehyde resins, melamine resins, benzoguanamine resins, urea resins, polyamide resins, and epoxy resins. Specific examples of the polyvinyl-based resins include, but are not limited to, acrylic resins, polymethyl methacrylate resins, polyacrylonitrile resins, polyvinyl acetate resins, polyvinyl alcohol resins, and polyvinyl butyral resins. Specific examples of the polystyrene resins include, but are not limited to, polystyrene resins and styrene-acrylic copolymers. A specific example of the halogenated olefin resins includes, but are not limited to, polyvinly chloride. Specific examples of the polyester resins include, but are not limited to, polyethylene terephthalate and polybutylene terephthalate.

The resin layer optionally contains electroconductive powder. Specific examples of such electroconductive powder include, but are not limited to, metal powder, carbon black, titanium oxide, tin oxide, and zinc oxide. The average particle diameter of such electroconductive powder is preferably 1 μm or less. When the average particle diameter is too large, controlling electric resistance may become difficult.

The resin layer described above can be formed by, for example, dissolving a silicone resin, etc. in a solvent to prepare a liquid application and applying the liquid application to the surface of the core material described above by a known application method followed by drying and baking. Specific examples of the application methods include, but are not limited to, a dip coating method, a spray coating method, and a brushing method.

There is no specific limit to the solvent and the solvent can be selected to a particular application. Specific examples thereof include, but are not limited to, toluene, xylene, methylethyl ketone, methylisobutyll ketone, and methyl cellosolve, and butylacetate.

There is no specific limit to the baking. An external heating system or an internal heating system can be used. For example, a fixed electric furnace, a fluid electric furnace, a rotary electric furnace, a method of using a burner furnace, and a method of using a microwave can be suitably used.

The content of the resin layer in carrier is preferably from 0.01% by weight to 5.0% by weight. A content that is too small tends to make it difficult to form a uniform layer on the surface of the core material. A content that is too large tends to result in an excessively thick layer, thereby causing granulation between carrier particles.

As described above, the development agent of the present disclosure is suitably usable for image forming employing known electrophotography such as a magnetic single-component development method, a non-magnetic single-component development method, and a two-component development method. Since the development agent contains the toner of the present disclosure, quality images are formed free from degradation of the image quality (with regard to, for example, transfer and background fouling) by electrophotography using the development agent.

In the toner container of the present disclosure, the toner or the two-component development agent of the present disclosure is accommodated. The toner container is detachably attachable to an image forming apparatus conducting image forming using toner.

By using the toner of the present disclosure accommodated in the toner container of the present disclosure, quality images are formed free from degradation of the image quality (with regard to, for example, transfer and background fouling) by electrophotography using the development agent.

Images are formed by a method that includes at least: a process of charging the surface of an image bearing member; a process of developing a latent electrostatic image formed on the charged image bearing member with the development agent of the present disclosure; a process of transferring the toner image formed on the image bearing member to an image support member (image recording medium); and a process of fixing the transferred toner image with a fixing member having a roller-like form or a belt-like form by applying heat and pressure to obtain a fixed image with other optional processes such as a discharging process, a cleaning process, a recycling process, and a control process.

The image forming apparatus of the present disclosure has at least: an image bearing member (latent image bearing member; photoreceptor); a charging device (charger) to charge the surface of the image bearing member; a latent electrostatic image forming device to irradiate the image bearing member to form a latent electrostatic image thereon; a development device that accommodates the toner of the present disclosure to develop the latent electrostatic image to form a toner image; a transfer device to transfer the toner image formed on the image bearing member to an image support member (recording medium); a fixing device to fix the transferred toner image by a fixing member to obtain a fixed image; and other suitably selected optional devices such as a discharging device, a cleaning device, a recycling device, and a controlling device.

In the image forming apparatus, the latent electrostatic image forming device forms a latent electrostatic image on the image bearing member. The development process develops the latent electrostatic image with the toner of the present disclosure to form a visible image. The transfer device transfers the visible image to a recording medium. The fixing device fixes the transferred image transferred to the recording medium.

In the development process in the image forming method, a latent electrostatic image is developed with the toner of the present disclosure to form a visible image. Therefore, quality images are formed with excellent cleanability, quality, and durability.

The image forming apparatus described above may have a process cartridge detachably attachable thereto, which integrally supports at least a latent electrostatic image bearing member (image bearing member) where a latent electrostatic image is formed and a development device to develop the latent electrostatic image formed on the image bearing member with the development agent of the present disclosure. The process cartridge of the present disclosure furthermore integrally supports other suitably selected optional devices. In the development device, the development agent can be used accommodated in a development agent container.

The toner of the present disclosure can be used accommodated in a toner container.

The process cartridge provided to an image forming apparatus for use in the image forming method described above has at least an image bearing member and a development device to develop a latent electrostatic image formed on the image bearing member using the toner of the present disclosure to form a visible image. The process cartridge is detachably attachable to an image forming apparatus and user friendly. In addition, since the toner of the present disclosure is used, quality images having excellent cleanability, quality of images, and durability are produced.

Each process and device are described in detail below.

As described above, the image forming apparatus includes at least: a latent image bearing member (image bearing member); a charging device (charger); a latent electrostatic image forming device (irradiator); a development device; a transfer device; a fixing device, and other suitably selected optional devices such as a discharging device, a cleaning device, a recycling device, and a controlling device.

In the latent electrostatic image forming process, latent electrostatic images are formed on the image bearing member. Latent electrostatic images can be formed by, for example, applying a bias to the surface of the image bearing member with the charging device to uniformly charge the surface and exposing the surface to light using the irradiator according to image data.

There is no specific limit to the material, the form, the structure, and the size of the image bearing member and any known image bearing member can be suitably selected to a particular application. A drum-like form is preferable. Inorganic image bearing members formed of amorphous silicon, selenium, etc. and organic photoconductor (OPC) formed of polysilane, phthalopolymethine, etc. are used as the image bearing member. In particular, amorphous silicon image bearing members are preferable in terms of the length of working life.

There is no specific limit to the charging device and any charging device can be selected to a particular application. For example, a known contact type charging device having an electroconductive or semi-conductive roller, brush, film, or rubber blade or a known non-contact type charging device such as corotron, or scrotron using corona discharging are suitably used. In addition, it is preferable that the charging device is arranged in contact or not in contact with an image bearing member and charges the surface of the image bearing member by applying a direct voltage or a direct voltage on which an alternating voltage is superimposed to the surface of an image bearing member. Moreover, it is preferable that the charging device is a charging roller arranged in the proximity of the image bearing member via a gap tape to be not in contact therewith and charges the surface of the image bearing member by applying a direct voltage or a direct voltage on which an alternating voltage is superimposed to the charging roller.

Any irradiation device that can irradiate the surface of an image bearing member charged by a charging device according to image data is suitably selected and used. Specific examples of such irradiating devices include, but are not limited to, a photocopying optical system, a rod lens array system, a laser optical system, or a liquid crystal shutter optical system. Furthermore, a rear side irradiation system in which the image bearing manger is irradiated from the rear side thereof can be also employed.

The development process is to form a visible image by developing a latent electrostatic image with the development agent of the present disclosure.

Any known development device that can conduct development with the toner or the development agent of the present disclosure is usable and suitably selected to a particular application. For example, a development device is suitable that accommodates the toner or the development agent of the present disclosure and includes at least a development agent bearing member which provides the toner or the development agent to a latent electrostatic image in a contact or non-contact manner. Preferably the development device includes a development agent or toner container detachably attachable to the development device.

The development device is either of a dry development type or a wet development type and in addition can be of a single color development type or a multi-color development type. A development device is suitable that includes, for example, a stirrer that stirs and triboelectrically charges the toner or the development agent and a rotary magnet roller. In the development device, for example, toner and carrier are mixed and stirred to triboelectrically charge the toner. The charged toner stands on the surface of the rotating magnet roller like filaments to form a magnetic brush. Since the magnet roller is provided in the vicinity of an image bearing member, part of the toner forming the magnet brush borne on the surface of the magnet roller is transferred to the surface of the image bearing member by electric attraction force. As a result, the latent electrostatic image is developed with the toner to form a visible toner image on the surface of the image bearing member. It is preferable to apply an alternating electric field to move the toner to the surface of the image bearing member.

The transfer process is to transfer a visible image to a transfer element (transfer medium) by a transfer device. It is preferable to employ a system in which a visible image is primarily transferred to an intermediate transfer body and thereafter secondarily transferred to a transfer element. Furthermore, it is also preferable to employ a system including a primary transfer process of transferring a visible image developed with two or more color toner, preferably, full color toner, to an intermediate transfer body to form a complex transferred image and a secondary transfer process of transferring the complex transferred image to a transfer body.

The visible image can be transferred by, for example, a transfer charger to charge the image bearing member.

The transfer device preferably has a primary transfer device to form a complex transfer image by transferring the visible image to the intermediate transfer body and a secondary transfer device to transfer the complex transfer image to transfer element (recording medium).

The transfer device (the primary transfer device and the secondary transfer device) preferably has a transfer unit that peel-off charges the visible image formed on the image bearing member toward the transfer medium. It is suitable to provide a single or more transfer devices. Specific examples of the transfer units include, but are not limited to, a corona transfer unit employing corona discharging, a transfer belt, a transfer roller, a pressure transfer roller, and an adhesive transfer unit.

There is no specific limit to the intermediate transfer body and it is possible to make a choice from known devices to a particular application. For example, a transfer belt is suitable.

There is no specific limit to the transfer element and any known recording medium (typically recording paper) can be suitably used.

The fixing process is to fix a visible image transferred to a transfer element by a fixing device. Fixing can be conducted every time a color toner image is transferred or at once for a multi-color overlapped image.

There is no specific limit to the fixing device and it can be suitably selected to a particular application. It is preferable to conduct fixing by heat and pressure by using a known fixing member. The fixing member preferably has a roller-like form or a belt like form. For example, it is suitable to use a combination of a hearing roller and a pressure roller or a combination of a heating roller, a pressure roller, and an endless belt. The heating temperature is preferably from 80° C. to 200° C.

In the present disclosure, it is suitable to use a fixing device including a heating substance that has a heating substance, a film that contacts the heating substance, and a pressure member that is pressed against the heating substance via the film and conducting heat and pressure fixing while the transfer element (transfer medium) on which an un-fixed image is formed passes between the film and the pressure member.

Depending on particular applications, for example, a known optical fixing device can be used together with or instead of the fixing device.

The discharging process is to apply a discharging bias to an image bearing member to conduct discharging by a discharging device.

There is no specific limit to the discharging device if a discharging bias can be applied to an image bearing member and any known discharging device can be used. For example, a discharging lamp is suitable.

The cleaning process is to remove toner remaining on an image bearing member by using a cleaner.

Any known cleaning device that can remove the toner remaining on the surface of the image bearing member can be selected and usable. For example, a magnetic brush cleaner, an electrostatic brush cleaner, a magnetic roller cleaner, a blade cleaner, a brush cleaner, and a web cleaner are suitable.

The recycling process is to return toner removed in the cleaning process to the development device for reuse by using a recycling device.

There is no specific limit to the recycling device. For example, any known transfer device is suitable.

The control process is to control each process by a controller.

There is no specific limit to the controller as long as the controller controls the behavior of each device. For example, devices such as a sequencer and a computer are suitable.

Having generally described preferred embodiments of this invention, further understanding can be obtained by reference to certain specific examples which are provided herein for the purpose of illustration only and are not intended to be limiting.

In the descriptions in the following examples, the numbers represent weight ratios in parts, unless otherwise specified.

EXAMPLES

Next, the present disclosure is described in detail with reference to Examples and Comparative Examples but not limited thereto.

Manufacturing of Mother Toner Particle by Emulsification Method—Oil Phase/Aqueous Phase Synthesis of Particulate Liquid Dispersion The following recipe was placed in a reaction container equipped with a stirrer and a thermometer and stirred at 400 rpm for 15 minutes to obtain a white emulsion:

Water: 683 parts

Sodium salt of sulfuric acid ester of an adduct of methacrylic acid with ethyleneoxide (EREMINOR RS-30, manufactured by Sanyo Chemical Industries, Ltd.): 11 parts Styrene: 83 parts Methacrylic acid: 83 parts Butyl acrylate: 110 parts Ammonium persulfate: 1 part.

The system was heated to 75° C. to conduct reaction for five hours. Furthermore, 30 parts of 1% ammonium persulfate aqueous solution was added followed by aging at 75° C. for five hours to obtain an aqueous liquid dispersion of [Particulate liquid dispersion 1] of a vinyl resin (copolymer of sodium salt of sulfuric acid of styrene-methacrylic acid-butyl acrylate—an adduct of methacrylic acid with ethyleneoxide. [Particulate liquid dispersion 1] has a weight average particle diameter of 105 nm as measured by LA-920. A resin portion was isolated by drying a portion of [Particulate liquid dispersion 1]. The resin portion has a glass transition temperature (Tg) of 59° C. and a weight average molecular weight of 150,000.

Preparation of Aqueous Phase 990 parts of deionized water, 83 parts of [Particulate liquid dispersion 1], 37 parts of 48.5% by weight aqueous solution of sodium dodecyldiphenyl etherdisulfonate (EREMINOR MON-7, manufactured by Sanyo Chemical Industries, Ltd.), and 90 parts of ethyl acetate were mixed and stirred to obtain milk white liquid. This was determined as [Aqueous phase 1].

Synthesis of Low Molecular Weight Polyester

The following components are placed in a reaction container equipped with a condenser, a stirrer, and a nitrogen introducing tube to conduct reaction at 230° C. at normal pressure for 8 hours followed by 5 hour reaction with a reduced pressure of 10 mmHg to 15 mmHg:

Adduct of bisphenol A with 2 mols of ethylene oxide: 229 parts

Adduct of bisphenol A with 3 mols of propylene oxide: 529 parts

Terephthalic acid: 208 parts

Trimellitic anhydride: 46 parts

Dibutyl tin oxide: 2 parts

Thereafter, 44 parts of trimellitic acid was put into the reaction container to conduct reaction at 180° C. and normal pressure for 2 hours to obtain [Low Molecular Weight Polyester 1]. [Low Molecular Weight Polyester 1] had a number average molecular weight of 2,500, a weight average molecular weight of 6,700, a glass transition temperature of 43° C., and an acid value of 25 mgKOH/g.

Synthesis of Intermediate Polyester and Prepolymer

The following components were placed in a container equipped with a condenser, a stirrer and a nitrogen introducing tube to conduct reaction at 230° C. under normal pressure for 8 hours followed by another reaction for 5 hours with a reduced pressure of 10 mmHg to 15 mmHg to synthesize [Intermediate polyester 1]:

Adduct of bisphenol A with 2 mols of ethylene oxide: 682 parts

Adduct of bisphenol A with 2 mole of propylene oxide: 81 parts

Terephthalic acid: 283 parts

Trimellitic anhydride: 22 parts

Dibutyl tin oxide: 2 parts

Thus-obtained [Intermediate polyester 1] had a number average molecular weight of 2,100, a weight average molecular weight of 9,500, a glass transition temperature of 55° C., an acid value of 0.5 mgKOH/g, and a hydroxyl value of 51 mgKOH/g.

Next, 410 parts of [Intermediate polyester 1], 89 parts of isophorone diisocyanate, and 500 parts of ethyl acetate were placed in a reaction container equipped with a condenser, stirrer, and a nitrogen introducing tube to conduct reaction at 100° C. for 5 hours to obtain [Prepolymer 1]. The weight % of the isolated isocyanate of [Prepolymer 1] was 1.53%.

Synthesis of Ketimine 170 parts of isophoronediamine and 75 parts of methyl ethyl ketone were placed in a reaction container equipped with a stirrer and a thermometer to conduct reaction at 50° C. for 5 hours to obtain [Ketimine compound 1]. [Ketimine compound 1] had an amine value of 418 mgKOH/g.

Synthesis of Master Batch 35 parts of water, 40 parts of phthalocyanine pigment FG 7351 (manufactured by Toyo Ink Co., Ltd.), and 60 parts of polyester resin RS 801 (manufactured by Sanyo Chemical Industries) were mixed by a HENSCHEL MIXER (manufactured by NIPPON COKE & ENGINEERING. CO., LTD.) and the mixture was mixed and kneaded at 150° C. for 30 minutes by a twin-shaft roll and flattened and cooled down followed by pulverization by a pulverizer to obtain [Master batch 1].

Preparation of Oil Phase

The following components were placed in a container equipped with a stirrer and a thermometer.

[Low molecular weight polyester 1]: 378 parts

Carnauba wax: 110 parts

Salicylic acid metal complex (CCA): E-84, manufactured by Orient Chemical Industries, Ltd.): 22 parts Ethyl acetate: 947 parts The mixture was heated to 80° C. while stirring it and thereafter held at 80° C. for 5 hours followed by cooling down to 30° C. in one hour. Next, 500 parts of [Master batch 1] and 500 parts of ethyl acetate were placed in the container followed by mixing for one hour to obtain a [Raw material solution 1].

1,324 parts of [Raw material solution 1] was transferred to a container to disperse wax and carbon black using a bead mill (ULTRAVISCOMILL from AIMEX) under the following conditions:

Liquid feeding speed: 1 kg/hour

Disc rotation perimeter speed: 6 msec

Diameter of zirconia beads: 0.5 mm

Filling factor of zirconia beads: 80% by volume 3 passes

Next, 1,324 parts of 65% ethyl acetate solution of [Low molecular weight polyester 1] was added followed by one pass by the bead mill under the conditions mentioned above to obtain [Pigment liquid dispersion 1]. The concentration of the solid portion of [Pigment liquid dispersion 1] was 50% at 130° C. for 30 minutes.

Emulsification 648 parts of [Pigment liquid dispersion 1], 154 parts of [Prepolymer 1], and 6.6 parts of [Ketimine compound 1] were placed in a container and mixed by a TK HOMOMIXER (manufactured by Tokushu Kika Kogyo Co., Ltd.) at 5,000 rpm for one minute. Thereafter, 1,200 parts of [Aqueous phase 1] was put in the container and the mixture was mixed by the TK HOMOMIXER at 13,000 rpm for 20 minutes to obtain [Emulsified slurry 1].

Form Control 3.15 parts of CELLOGEN™ BS-H (manufactured by DAI-ICHI KOGYO SEIYAKU CO., LTD.) was added little by little to 75.6 parts of deionized water being stirred by a TK HOMOMIXER (manufactured by Tokushu Kika Kogyo Co., Ltd.) at 2,000 rotations per minute (rpm). After the addition, the system was stirred for 30 minutes while keeping the temperature at 20° C. 43.3 parts of 48.5% by weight aqueous solution of sodium dodecyldiphenyl ether disulfonate (ERMINOR MON-7, manufactured by Sanyo Chemical Industries, Ltd.) was added to the obtained CELLOGEN™ solution followed by stirring for 5 minutes while keeping the temperature at 20° C. 2,000 parts of [Emulsified slurry 1] was added thereto followed by mixing by the TK HOMOMIXER at 2,000 rpm for one hour to obtain [Form controlled slurry 1].

Removal of Solvent

[Emulsified Slurry 1] was placed in a container equipped with a stirrer and a thermometer followed by removal of the solvent at 30° C. for 8 hours. Subsequent to a 4 hour aging at 45° C., [Slurry dispersion 1] was obtained.

Washing to Drying

After 100 parts of [Slurry dispersion 1] is filtered with a reduced pressure;

(1): 100 parts of deionized water was added to the filtered cake followed by mixing by a TK HOMOMIXER (at 12,000 rpm for 10 minutes);

(2): 100 parts of 10% sodium hydroxide was added to the filtered cake obtained in (1) and the resultant was mixed by a TK HOMOMIXER (at 12,000 rpm for 30 minutes) followed by filtration with a reduced pressure;

(3): 100 parts of 10% sodium hydrochloric acid was added to the filtered cake obtained in (2) and the resultant was mixed by a TK HOMOMIXER (at 12,000 rpm for 10 minutes) followed by filtration; and (4): 300 parts of deionized water was added to the filtered cake of (3) and the resultant was mixed by a TK HOMOMIXER at 12,000 rpm for 10 minutes followed by filtration. This process was repeated twice to obtain [Filtered cake 1].

[Filtered cake 1] was dried at 45° C. for 48 hours by a circulating drier. The dried cake was sieved using a screen having an opening of 75 μm to obtain [Mother toner particle A]. [Mother toner particle A] had a volume average particle diameter (Dv) of 5.6 μm.

The resin particle having a surface covered with two or more kinds of particulates was obtained in the following manner:

Manufacturing of Resin Particle AA covered with two kinds of Particulates

Surface-treated silica (H3004, average particle diameter: 8 nm, manufactured by Wacker Asahikasei Silicone Co., Ltd.) and powder of zinc stearate particulate having an average particle diameter of 80 nm prepared by classifying powder of zinc stearate particulate (SZ-2000, average particle diameter: 2.8 μm, manufactured by Sakai Chemical Industry Co., Ltd.) were weighed and mixed with 10 g of PMMA particulate (MP-300, average particle diameter: 0.1 μm, manufactured by Soken Chemical Engineering Co., Ltd.) available on market such that the covering ratio was 9:1 and the surface of the PMMA particulate was covered with a single layer.

The mixture was placed in a hybridization system (NHS-O, manufactured by Nara Machinery Co., Ltd.) and the system was rotated at 10,000 rotation per minute (rpm) for five minutes to form a particulate layer formed of the surface-treated silica particle and zinc stearate particle on the surface of PMMA particulate. The thus-obtained resin particle to which the external additive was added was screened by a 25 μm mesh followed by removal of coarse particles and pulverization of loose agglomerated particles to obtain a resin particle AA (external additive of the present disclosure) covered with the two kinds of particulates.

Manufacturing of Resin Particle AB Covered with Two Kinds of Particulates

A resin particle AB (external additive of the present disclosure) covered with two kinds of particulates was manufactured in the same manner as in the manufacturing of the resin particle AA covered with the two kinds of particulates except that the PMMA particle (MP-300, average particle diameter: 0.1 μm) was changed to MP-5500 (average particle diameter:

0.4 μm) and the powder of zinc stearate particulate having an average particle diameter of 80 nm prepared by classifying powder of zinc stearate particulate (SZ-2000, average particle diameter: 2.8 μm, manufactured by Sakai Chemical Industry Co., Ltd.) was changed to surface-treated titanium oxide (M1-150AI, average particle diameter: 15 nm, manufactured by Tayca Corporation).

Manufacturing of Resin Particle AC Covered with Two Kinds of Particulates

A resin particle AC (external additive of the present disclosure) covered with two kinds of particulates was manufactured in the same manner as in the manufacturing of the resin particle AA except that the PMMA particle (MP-300, average particle diameter: 0.1 μm) was changed to MP-1600 (average particle diameter: 0.8 μm).

Manufacturing of Resin Particle BA Covered with Two Kinds of Particulates

The PMMA particle (formed of only MP-300) which was not covered with two kinds of particulates was determined as a resin particle BA.

Manufacturing of Resin Particle BB Covered with One Kind of Surface-Treated Silica Particulates A particulate layer formed of surface-treated silica particle was formed on the surface of the PMMA particle in the same manner as in the manufacturing of the resin AA except that only the surface-treated silica (H3004, average particle diameter: 8 nm, manufactured by Wacker Asahikasei Silicone Co., Ltd.) was used without using the powder of zinc stearate particulate having an average particle diameter of 80 nm prepared by classifying powder of zinc stearate particulate (SZ-2000, average particle diameter: 2.8 μm, manufactured by Sakai Chemical Industry Co., Ltd.). The thus-obtained resin particle to which the external additive was added was screened by a 25 μm mesh followed by removal of coarse particles and pulverization of loose agglomerated particles to obtain a resin particle BB covered with the one kind of the surface-treated silica particulates.

Manufacturing of Resin Particle BC Covered with One Kind of Silica Particulates

A particulate layer formed of surface-treated silica particles was formed on the surface of the PMMA particle in the same manner as in the manufacturing of the resin AA except that the surface-treated silica (H3004, average particle diameter: 8 nm, manufactured by Wacker Asahikasei Silicone Co., Ltd.) was changed to particulates (X-24, average particle diameter: 120 nm, manufactured by Shin-Etsu Chemical Co. Ltd.) while not using the powder of zinc stearate particulate having an average particle diameter of 80 nm prepared by classifying powder of zinc stearate particulate (SZ-2000, average particle diameter: 2.8 μM, manufactured by Sakai Chemical Industry Co., Ltd.). The thus-obtained resin particle to which the external additive was added was screened by a 25 μm mesh followed by removal of coarse particles and pulverization of loose agglomerated particles to obtain a resin particle BC covered with one kind of the silica particulates.

Manufacturing of Carrier

Carrier for use in a development agent or carrier to measure the charging size of toner was obtained by applying coating liquid in which 200 parts of silicone resin solution (manufactured by Shin-Etsu Chemicals Co., Ltd.) and 3 parts of carbon black (manufactured by Cabot Corporation) were dispersed in toluene to 2,500 parts of ferrite core by a fluid bed type spraying method to cover the surface of the core material followed by two hour baking in an electric furnace at 300° C. The carrier used had a relatively sharp particle size distribution and an average particle diameter of from 30 μm to 60 μm.

Example 1

Development Agent X1

100 parts of [Mother toner particle A] was mixed with 3 parts of the resin particle AA by a HENSCHEL MIXER under a condition of a peripheral speed of the stirring wing of 35 m/s to manufacture [Toner X1].

7 parts of the thus obtained [Toner X1] and 93 parts of [Carrier] were mixed and stirred to prepare [Development agent X1] having a toner concentration of 7% by weight.

Example 2

[Toner X2] was manufactured in the same manner as in Example 1 except that 3 parts of the resin particle AA was changed to 3 parts of the resin particle AB and the speed of the stirring wing of the HENSCHEL MIXER was changed from 35 m/s to 55 m/s.

7 parts of the thus obtained [Toner X2] and 93 parts of [Carrier] were mixed and stirred to prepare [Development agent X2] having a toner concentration of 7% by weight.

Example 3

[Toner X3] was manufactured in the same manner as in Example 2 except that 3 parts of the resin particle AB was changed to 3 parts of the resin particle AC.

7 parts of the thus obtained [Toner X3] and 93 parts of [Carrier] were mixed and stirred to prepare [Development agent X3] having a toner concentration of 7% by weight.

Comparative Example 1

[Toner Y1] was manufactured in the same manner as in Example 1 except that the resin particle AA was changed to the resin particle BA (PMMA particle, MP-300, average particle diameter: 0.1 μm) as it was (the state in which the resin particle was not covered with non-surface-treated silica particle or metal compound particulate).

7 parts of the thus obtained [Toner 1] and 93 parts of [Carrier] were mixed and stirred to prepare [Development agent Y1] having a toner concentration of 7% by weight.

Comparative Example 2

[Toner Y2] was manufactured in the same manner as in Example 2 except that 3 parts of the resin particle AB was changed to 3 parts of the resin particle BB.

7 parts of the thus obtained [Toner Y2] and 93 parts of [Carrier] were mixed and stirred to prepare [Development agent Y2] having a toner concentration of 7% by weight.

Comparative Example 3

[Toner Y3] was manufactured in the same manner as in Example 1 except that 3 parts of the resin particle AA was changed to 3 parts of the resin particle BC.

7 parts of the thus obtained [Toner Y3] and 93 parts of [Carrier] were mixed and stirred to prepare [Development agent Y3] having a toner concentration of 7% by weight.

Evaluation

Charging stability, quality of image, granularity and sharpness of image, and high temperature stability of [Development agents X1] to [Development agents X3] and [Development agents Y1] to [Development agents Y3] of Examples 1 to 3 and Comparative Examples 1 to 3, respectively, were evaluated in total by using an image forming apparatus having the following configuration. The conditions of the evaluation items are described below. The evaluation results are shown in Table 1.

Image Forming Apparatus

The structure of the image forming apparatus for use in evaluation was as follows:

In the image forming apparatus, there are provided: a charging roller located in contact with or in the proximity of a drum photoreceptor serving as an image bearing member to charge the drum photoreceptor; an irradiator to form a latent electrostatic image on the drum photoreceptor; a development device to render the latent electrostatic image visible with a development agent to obtain a toner image; a transfer belt to transfer the toner image to a transfer sheet; a cleaning device to remove toner remaining on the drum photoreceptor; a discharging lamp to discharge residual charge on the drum photoreceptor, and an optical sensor to control the voltage applied by the charging roller and the toner concentration of the development agent. In addition, the toner of each of Examples or Comparative Examples is replenished to the development device by a toner supplying device via a toner supplying mouth. The imaging operation by the image forming apparatus is as follows: The drum photoreceptor rotates counterclockwise. The drum photoreceptor is discharged by discharging light to have an averaged surface voltage of 0 V to −150 V as the reference voltage.

Next, the drum photoreceptor is charged by the charging roller to have a surface voltage of about −1,000 V. Next, the surface of the drum photoreceptor irradiated by the irradiator has a surface voltage of from 0 V to −200 V at the irradiated portion (image portion).

The toner on the sleeve is attached to the image portion by the development device. While the drum photoreceptor on which a toner image is formed rotationarily moves, a transfer sheet is fed from a sheet feeding unit in such a timing that the the front end of the transfer sheet contacts the front end of the image at the transfer belt to transfer the toner image on the drum photoreceptor to the transfer sheet by the transfer belt. Thereafter, the transfer sheet is sent to a fixing unit where the toner adheres to the transfer sheet by heat and pressure and thereafter discharged as a photocopy. The toner remaining on the drum photoreceptor is scraped off by the cleaning blade in the cleaning device. Thereafter residual charge is removed from the drum photoreceptor by discharging light to be back to the initial state thereof and ready for producing the next image.

In the image forming apparatus described above, the toner and the development agent of Examples and Comparative Examples are evaluated as to the following.

Evaluation and Evaluation Conditions

1. Evaluation on Charging Stability (Charging Power)

A blow-off charging size measuring instrument (manufactured by KYOCERA Chemical Corporation) and E-SAPRT (Model EST-II, manufactured by Hosokawa Micron Corporation) were used for evaluation.

With regard to the charging size distribution width, E-SAPRT (Model EST-II, manufactured by Hosokawa Micron Corporation) was used for data analysis and evaluation according to the evaluation method described below. FIG. 1 is a graph illustrating an example of the charging size distribution curve for use in the charging stability evaluation.

Evaluation Method

To each carrier for electrostatic image development, each toner was weighed and mixed such that the toner concentration was 4.5%, 7% m, and 12% followed by one minute stirring and mixing by a ball mill to prepare development agents for electrostatic image development.

The charging size of each toner at each concentration was measured. From the measured charging size distribution curve (graph), the number of the resin particle N at the peak value of the charging size distribution and its half value N/2 were calculated and the two intersections [(Qn, N/2) and (Qp, N/2) of FIG. 1] of N/2 values and the charging size distribution curve were obtained. (Qn<Qp, as in FIG. 1)

From the thus-obtained Qn, Qc, and Qp, Wa value and Wb value were calculated according to the following relation to evaluate the sharpness (charging stability and the charging power) of the charging size distribution.

$$|(Qn-Qc)/Qc|\times 100=Wa \text{ value}$$

$$|(Qp-Qc)/Qc|\times 100=Wb \text{ value}$$

The evaluation criteria for the charging stability (charging power) are as follows:

G (Good): Both Wa value and Wb value are 20 or less

F (Fair): One of Wa value and Wb value is greater than 20

B (Bad): Both Wa value and Wb value are greater than 20

2. Image Quality

Image quality was evaluated totally for degradation (to be specific, poor transfer performance, production of background fouling image) of the quality of produced images. Transfer performance was evaluated by using an image forming apparatus (manufactured by Ricoh Co., Ltd.) with a run length of 5,000 sheets. Thereafter, a solid black image was passed through the image forming apparatus to scale the transfer performance of the image visually. In addition, the background fouling image was evaluated by using an image forming apparatus (manufactured by Ricoh Co., Ltd.) as follows: After a run length of 5,000 sheets, the image forming apparatus was suspended during printing of a white sheet image and the development agent on the image bearing member after development was transferred by a Scotch tape (Sumitomo 3M). The difference between the tape and non-transferred tape was quantitatively evaluated by a spectrodensitometer (manufactured by X-Rite). The difference less than 0.30 was rated good and, 0.30 or greater, bad. In combination of these two, both images having good quality were rated as G (Good), both images having not good but allowable quality were rated as F (Fair), and both images having not good quality were rated as B (Bad).

3. Image Granularity and Sharpness

Using a digital full color photocopying machine (imagio-Color 2800, manufactured by Ricoh Co., Ltd.), monochrome photographic images were printed and evaluated visually as to the level of granularity and sharpness. From good to bad, the rating was:

E (Excellent) was on a par with offset printing

G (Good) was slightly inferior to offset printing

F (Fair) was significantly inferior to offset printing

B (Bad) was the same as conventional electrophotographic images (extremely bad).

4. Evaluation on High Temperature Stability

The toner was preserved at 55° C. for 8 hours and thereafter screened with a sieve having a 42 mesh for 2 minutes and the remaining ratio of the toner on the wire screen was determined as an indicator of the high temperature stability. The better the high temperature stability, the less the remaining ratio. High temperature stability was scaled by the following four levels.

B (Bad): 30% or higher

F (Fair): 20% to less than 30%

G (Good): 10% to less than 20%

E (Excellent): less than 10%

5. Total Evaluation

The total evaluation was made by 4 level scaling.

E (Excellent): Extremely good on image quality amelioration and competence of development agent for electrophotography G (good): Good on image quality amelioration and competence of development agent for electrophotography F (Fair): Trade-off between image quality amelioration and competence of development agent for electrophotography B (Bad): Inferior to conventional art in terms of image quality amelioration and competence of development agent for electrophotography

TABLE 1

| | Development agent and toner | Resin particle | External additive of resin particulate (two kinds of particulates) | | Mixing speed of external additive |
|---|---|---|---|---|---|
| | | | One particulate | Other particulate | |
| Example 1 | X1 | Resin particulate AA (MP-300 + (the external additive on the right) | Surface-treated silica (H3004) | Particulate of zinc stearate (SZ-2000) | 35 m/s |
| Example 2 | X2 | Resin particulate AB (MP-5500 + (the external additive on the right) | Surface-treated silica (H3004) | Particulate of surface-treated titanium oxide (MT-150AI) | 55 m/s |
| Example 3 | X3 | Resin particulate AC (MP-1600 + (the external additive on the right) | Surface-treated silica (H3004) | Particulate of zinc stearate (SZ-2000) | 55 m/s |
| Comparative Example 1 | Y1 | Resin particulate BA (MP-300 | — | — | 35 m/s |
| Comparative Example 2 | Y2 | Resin particulate BB (MP-300 + (the external additive on the right) | Surface-treated silica (H3004) | — | 55 m/s |
| Comparative Example 3 | Y3 | Resin particulate BC (MP-300 + (the external additive on the right) | Silica particulate (X-24) | — | 35 m/s |

| | Charging stability | Image quality | Image granularity/sharpness | High temperature stability | Total |
|---|---|---|---|---|---|
| Example 1 | G | G | G | G | G |
| Example 2 | G | G | G | G | G |
| Example 3 | F | G | E | E | G |
| Comparative Example 1 | B | G | F | G | F |
| Comparative Example 2 | G | G | F | E | F |
| Comparative Example 3 | F | G | G | F | F |

As seen in the result of Table 1, the toner of Example 1 or 2 to which the external additive of the present disclosure [the resin particle covered with two kinds of particulates, i.e., surface-treated silica particle and non-silicon metal compound particle] was added to the surface of mother toner particle had good charging stability, image quality, image granularity/sharpness, and high temperature stability and was evaluated as sufficient (good) for practical use in the total evaluation. In Example 3, one of the Wa value and the Wb value was greater than 20 (rated as fair) for charging size (charging power) and the toner had good image quality, image granularity/sharpness, and high temperature stability and was evaluated as sufficient (good) for practical use in the total evaluation.

By contrast, with regard to Comparative Example 1 in which the resin particle BA (PMMA particle, MP-300 was used as it was (in which the resin particle was not covered with two kinds of particulates) as an external additive to cover the surface of mother toner particles, both Wa value and Wb value were greater than 20 (rated as bad). Also the toner was significantly inferior to offset printing with regard to the image granularity/sharpness (rated as fair) and rated as having a problem for practical use (bad) in the total evaluation.

In addition, with regard to Comparative Example 2 in which the resin particle BB covered with only one kind of the surface-treated silica particulate was externally added to the surface of the mother toner particle, the toner had excellent high temperature stability (rated as excellent) but was rated as extremely bad with regard to the image granularity/sharpness. In the total evaluation, the toner was rated as having a problem for practical use (bad).

In addition, with regard to Comparative Example 3 in which the resin particle BC covered with only one kind of the silica particulate was externally added to the surface of the mother toner particle, one of Wa value and Wb value was greater than 20 (rated as fair) and the high temperature stability was from 20% to 30% (rated as fair). As a consequence, the image quality improvement and the suitability as the development agent for electrophotography were trade-off. Therefore, the total evaluation was rated as fair but with a slightly practical problem (rated as fair).

Judging from the results, it was confirmed that toner was provided which has excellent high temperature stability with little or no changes in properties such as charging size, fluidity, and agglomeration degree while suppressing the degradation of image quality (such as bad transfer and occurrence of background fouling) by good coverage of mother toner particles containing a binder resin and a coloring agent demonstrated by the structure in which resin particles covered with at least two kinds of particulates of hydrophobized silica particulates and non-silicon metal compound particulates were externally added to cover the surface of the mother toner particles.

As described above, resin particles covered with at least two kinds of particulates having different compositions (e.g., surface-treated silica particles and non-silicon containing metal compound particulates) are contained as an external additive for toner for use in the development agent of the present disclosure. Therefore, if electrophotographic images are formed by the image forming apparatus of the present disclosure using the development agent, quality images are formed which have excellent cleanability, image quality, and durability.

Having now fully described embodiments of the present invention, it will be apparent to one of ordinary skill in the art that many changes and modifications can be made thereto without departing from the spirit and scope of embodiments of the invention as set forth herein.

What is claimed is:

1. A toner, comprising:
a mother toner particle comprising a binder resin; and
an external additive for toner consisting of a resin particle and a plurality of metal oxide particulates comprising different compositions present on the resin particle,
wherein the external additive for toner is present on the mother toner particle, and
the plurality of metal oxide particulates uniformly covers a surface of the resin particle with a single layer.

2. The toner according to claim 1, wherein the binder resin comprises at least one selected from the group consisting of a non-modified polyester consisting of an ester bonding unit, a modified polyester comprising an ester bonding unit and a bonding unit other than the ester bonding unit, and a crystalline polyester.

3. A two component development agent, comprising:
the toner of claim 1; and
a carrier.

4. A toner container, comprising:
a container; and
the toner of claim 1,
wherein the toner container is detachably attachable to an image forming apparatus.

5. A toner container, comprising:
a container; and
the two component development agent of claim 3,
wherein the toner container is detachably attachable to an image forming apparatus.

6. An image forming apparatus, comprising:
an image bearing member;
a charging device to charge a surface of the image bearing member to form a latent electrostatic image thereon;
a development device to develop the latent electrostatic image with the toner of claim 1 to form a toner image on the surface of the image bearing member;
a transfer device to transfer the toner image to an image support member; and
a fixing device to fix the toner image on the image support member to obtain a fixed image.

7. The toner of claim 1, wherein the metal oxide particulates have a volume average particle diameter Dv of 100 nm or less.

8. The toner of claim 1, wherein the metal oxide particulates have a volume average particle diameter Dv of from 6 nm to 80 nm.

9. The toner of claim 1, wherein the plurality of metal oxide particulates comprises different kinds of metal compound particles.

10. The toner of claim 1, wherein the plurality of metal oxide particulates comprises a silica-containing particle and a non-silica-containing particle.

11. The toner of claim 1, wherein at least one of the metal oxide particulates has a hydrophobized surface.

12. The toner of claim 1, wherein the resin particle is selected from the group consisting of a non-cross-linked acrylic resin, a cross-linked acrylic resin, a non-cross- linked polyethylene resin, and a cross-linked polystyrene resin.

13. The toner of claim 1, wherein the mother toner particle further comprises a coloring agent.

14. The toner of claim 1, wherein the mother toner particle further comprises a releasing agent.

15. The toner of claim 14, wherein the releasing agent is a wax.

16. The toner of claim 1, wherein the mother toner particle further comprises a charge control agent.

17. The toner of claim 1, wherein the resin particle has a primary particle diameter of from 25 nm to 200 nm.

18. The toner of claim 11, wherein an amount of the metal oxide particulates having the hydrophobized surface is from 30 to 95 mass % of a total amount of the resin particle.

* * * * *